US011602209B1

(12) United States Patent
Magee

(10) Patent No.: US 11,602,209 B1
(45) Date of Patent: Mar. 14, 2023

(54) CATCH COMB

(71) Applicant: Harvey Magee, Hudson, FL (US)

(72) Inventor: Harvey Magee, Hudson, FL (US)

( * ) Notice: Subject to any disclaimer, the term of this patent is extended or adjusted under 35 U.S.C. 154(b) by 846 days.

(21) Appl. No.: 16/511,936

(22) Filed: Jul. 15, 2019

(51) Int. Cl.
*A45D 24/36* (2006.01)
*A45D 24/04* (2006.01)

(52) U.S. Cl.
CPC ..... *A45D 24/36* (2013.01); *A45D 24/04* (2013.01)

(58) Field of Classification Search
CPC ..... A45D 24/00; A45D 24/02; A45D 24/04; A45D 24/08; A45D 24/10; A45D 24/36; A45D 24/38; A45D 24/42; A45D 24/44; A45D 2/002; A45D 2/44; A45D 1/18; A45D 6/02; A45D 6/045; A46B 15/0055; A46B 15/0059
See application file for complete search history.

(56) References Cited

U.S. PATENT DOCUMENTS 3,173,428 A * 3/1965 Postel ..... A45D 1/18 219/241
4,032,747 A * 6/1977 Kunz ..... A45D 1/04 219/241
5,794,348 A * 8/1998 Scott ..... B26B 21/12 30/220
6,249,973 B1 * 6/2001 Hirano ..... B26B 21/12 30/55
2008/0110471 A1 * 5/2008 Oliver ..... A45D 24/02 15/207.2
2013/0247934 A1 * 9/2013 Han ..... A45D 2/002 132/269
2015/0122286 A1 * 5/2015 Valle ..... A45D 2/002 132/229

FOREIGN PATENT DOCUMENTS

CN 201550792 U * 8/2010

OTHER PUBLICATIONS

CN201550792U. Translation (Year: 2010).*

* cited by examiner

*Primary Examiner* — Cris L. Rodriguez
*Assistant Examiner* — Karim Asqiriba
(74) *Attorney, Agent, or Firm* — Edward P Dutkiewicz

(57) ABSTRACT

A catch comb comprising a right component and a left component which are joined together. There is a set of fixed teeth, and a set of movable teeth. The movable teeth are actuated by a grip trigger, which also has a position lock. There is also a rotatable angle indicator, so as to allow replication of angled cuts.

13 Claims, 19 Drawing Sheets

CATCH COMB

BACKGROUND OF THE INVENTION

Rule 1.78(F) (1) Disclosure

The Applicant has not submitted a related pending or patented non-provisional application within two months of the filing date of this present application. The invention is made by a single inventor, so there are no other inventors to be disclosed. This application is not under assignment to any other person or entity at this time.

Field of the Invention

The present invention relates to a Catch Comb and more particularly pertains to a comb for holding hair during cutting.

Description of the Prior Art

The use of combs for cutting hair is known in the prior art. More specifically, combs for cutting hair previously devised and utilized for the purpose of allowing a hair dresser to quickly cut hair are known to consist basically of familiar, expected, and obvious structural configurations, notwithstanding the number of designs encompassed by the prior art which has been developed for the fulfillment of countless objectives and requirements.

While the prior art devices fulfill their respective, particular objectives and requirements, the prior art does not describe a Catch Comb that allows a user to easily hold hair in a particular orientation during cutting.

In this respect, the catch comb, according to the present invention substantially departs from the conventional concepts and designs of the prior art, and in doing so provides an apparatus primarily developed for the purpose of a comb for holding hair during cutting.

Therefore, it can be appreciated that there exists a continuing need for a new and improved catch comb which can be used to allow a hair dresser to hold hair during cutting. In this regard, the present invention substantially fulfills this need.

SUMMARY OF THE INVENTION

In view of the foregoing disadvantages inherent in the known types of combs for cutting hair now present in the prior art, the present invention provides an improved catch comb. As such, the general purpose of the present invention, which will be described subsequently in greater detail, is to provide a new and improved catch comb which has all the advantages of the prior art and none of the disadvantages.

In describing this invention, the word "coupled" is used. By "coupled" is meant that the article or structure referred to is joined, either directly, or indirectly, to another article or structure. By "indirectly joined" is meant that there may be an intervening article or structure imposed between the two articles which are "coupled". "Directly joined" means that the two articles or structures are in contact with one another or are essentially continuous with one another.

By adjacent to a structure is meant that the location is near the identified structure.

To attain this, the present invention essentially comprises a catch comb comprising several components, in combination.

There are a pair of components, being a right component, a left component, a grip trigger, a grip trigger lock, a fixed comb, a movable gripper comb, and a rotatable angle indicator. The catch comb is fabricated of a rigid material.

The right component and the left component each have a handling end and a working end. The handling end of the right component and the handling end of the left component each have a generally rectilinear configuration, with an inner surface and an outer surface. The outer surface of the handling end right component and the handling end left component each comprising a top surface, a side surface, and a bottom surface.

The handling end of the right component and the handling end of the left component each have a proximal portion and a distal portion, each of which lie on a common axis. The proximal portion and the distal portion of the handling end right component are continuous with each other. The proximal portion and the distal portion of the handling end left component are continuous with each other.

The proximal portion of the handling end right component and the proximal portion of the handling end left component each have a terminus, with the terminus comprising at least one fixed hair pick protruding proximally from the terminus of the left component handling end proximal portion and right component handling end proximal portion. The left component and right component handling end proximal portion each have a plurality of removable hair pick recesses therein, with the hair pick recesses each having an associated removable hair pick. The removable hair picks are inserted into the hair pick recesses. with the hair picks protruding proximally from the terminus of the handling end proximal portion of both the right component and the left component.

The handling end inner surface of the right component and the handling end inner surface of the left component each have a recess therein.

The right component handling end outer side surface and the left component handling end outer side surface each have a rotatable angle indicator recess therein. Each rotatable angle indicator recess has an associated rotatable angle indicator. The rotatable angle indicator has an associated rotatable angle indicator pin.

The working end of the right component and the working end of the left component each are oriented along the common axis. The working end of the right component and the working end of the left component each has a generally rectilinear configuration.

The working end of the right component and the working end of the left component each has a generally rectilinear configuration, with an inner surface and an outer surface. The outer surface of the working end right component and the outer surface of the working end left component each comprises a top surface, a side surface, and a bottom surface.

The working end left component outer surface and the working end right component outer surface each has an outer surface recess therein.

The inner surface of the working end right component and the inner surface of the working end left component each has a recess therein.

The working end right component and the working end left component each has a proximal portion and a distal portion. The proximal portion of the working end right component is continuous with the distal portion of the handling end right component. The proximal portion of the working end left component is continuous with the distal portion of the handling end left component.

The recess of the handling end right component and the recess of the handling end left component each has a plurality of spring nests therein. Each of the spring nests of the handling end of the right component and each of the spring nests of the handling end of the left component has an associated spring.

The recess of the handling end right component and the recess of the handling end left component each has a plurality of handling end comb travel stops. The handling end right component and the handling end left component each has a plurality of fastener holes therein. Each of the fastener holes of the handling end right component and the handling end left component has an associated fastener.

The inner surface of the left component handling end has a plurality of joining apertures there in. The inner surface of the handling end right component has a plurality of joining protuberances which are configured to accept and mate with the joining apertures of the left component handling end inner surface.

The bottom surface of the left component handling end and the bottom surface of the right component handling end each has an stepped grip trigger recess therein.

The inner surface of the left component handling end and inner surface of the right component handling end each has a trigger pin boss. The trigger pin boss has a trigger pin aperture there through. The trigger pin aperture has an associated trigger pin.

The top surface of the left component handling end and the top surface of the right component handling end each has a grip trigger lock recess therein. Each grip trigger lock recess has a grip trigger lock retaining pin hole there through.

The left component handling end trigger lock retaining pin hole and right component handling end grip trigger lock retaining pin hole has an associated grip trigger lock retaining pin.

The recess of the working end right component and the recess of the working end left component has a plurality of spring nests therein. The spring nests of the working end of the right component and the spring nests of the working end of the left component each has an associated spring.

The recesses of both the working end right component and the working end left component, have a plurality of comb travel stops therein. The working end right component and the working end left component each has a plurality of fastener holes therein. Each of the fastener holes of the working end of the right component and the working end of the left component has an associated fastener.

The bottom surface of the working end right component and the bottom surface of the working end left component are coupled to form a stepped slot on the bottom surface of the coupled right component working end and left component working end. The working end bottom surface stepped slot has a first step and a second step.

The first step and the second step each have a side to side distance. The working end bottom surface stepped slot has a greater side to side distance than the side to side distance of the first step.

The grip trigger lock has an upper surface having a generally planar configuration, a lower surface having a stepped configuration, and a pair parallel, planar side surfaces. The side surfaces each have a grip trigger lock retaining pin hole there through.

The fixed comb has a generally rectilinear upper mounting portion and a multi toothed lower hair portion. The upper mounting portion has an distal end and a proximal end. The distal end and the proximal end of the upper mounting portion of the fixed comb each have a mounting pin hole there through. Each of the distal ends of the fixed comb and the proximal end upper mounting portion mounting pin holes have an associated mounting pin.

The upper mounting portion of the fixed comb is sized to be fixedly held within the first step of the stepped slot of the bottom surface of the working end right component and the stepped slot of the bottom surface of the working end left component. The teeth of the fixed comb multi toothed lower hair portion each have a movable gripper comb groove there through.

The movable gripper comb has a distal portion and a proximal portion. The distal portion of the movable gripper comb and the proximal portion of the movable gripper comb are continuous with each other.

The distal portion of the movable gripper comb has an upper engaging portion and a multi toothed lower portion. The movable gripper comb multi toothed lower portion teeth each have a proximal surface, a distal surface, and a pair of side surfaces, and a terminus. Each of the teeth of the movable gripper comb lower portion are configured to be slidably located within the movable gripper comb groove of the fixed comb multi toothed lower hair portion.

The movable gripper comb teeth each have an engaged location and the movable gripper comb teeth each have a stored location. The movable gripper comb teeth are in the stored location when each tooth of the movable gripper comb is contained with the movable gripper comb groove of the fixed comb multi toothed lower hair portion. The movable gripper comb teeth are in the engaged location when each movable gripper comb tooth is outside of the movable gripper comb groove of the fixed comb multi toothed lower hair portion. In the engaged location, the teeth of the movable gripper comb press the hair which is between the teeth of the fixed comb against an adjacent tooth of the fixed comb.

The upper engaging portion of the distal portion of the movable gripper comb has a generally T-shaped configuration, with an upper surface, a pair of parallel side surfaces, and a lower surface.

The lower surface of the upper engaging portion of the distal portion of the movable gripper comb is continuous with the multi toothed lower portion of the distal portion of the movable gripper comb.

The upper engaging portion of the distal portion of the movable gripper comb having a plurality of upwardly disposed spring contacting extensions. Each of the upwardly disposed spring contacting extensions has a generally rectilinear configuration.

The proximal portion of the movable gripper comb has an upper surface, a lower surface, and a pair of generally parallel side surfaces. The upper surface of the proximal portion of the movable gripper comb has grip trigger upward extension and a plurality of spring recesses therein. The lower surface of the proximal portion of the movable gripper comb has a grip trigger cam lobe cutout and a plurality of spring recesses therein.

The grip trigger has an upper end and a lower end. The grip trigger has a pair of generally parallel side surfaces, a front surface, a rear surface, an upper surface, and a lower surface.

The lower end of the grip trigger has a finger aperture there through. The upper end of the grip trigger has a trigger pin boss aperture there through with the trigger pin boss aperture sized to rotatably mount the grip trigger on the trigger pin boss.

The catch comb may also use accessories, such as the radius slider and the radius roller.

The radius slider has a mounting portion, a semicircular curved portion, and a connecting extension. The radius slider connecting extension is continuous with the radius slider mounting portion.

The radius slider semicircular portion has an outer surface, an inner surface, a proximal end, and a distal end. The distal end of the semicircular portion of the radius slider has a terminal edge.

The radius slider semicircular portion has a first end and a second end. The proximal end of the semicircular portion of the radius slider is continuous with the connecting extension.

The radius slider mounting portion has a generally C-shaped configuration, having a top and a bottom, with an opening therein.

There is a pair of generally parallel sides, being a mounting portion right side and a mounting portion left side. The mounting portion top has an outer surface and an inner surface, with a thickness there between. The mounting portion left side has an outer surface and an inner surface, with a thickness there between. The mounting portion right side has an outer surface and an inner surface with a thickness there between. The mounting portion right side outer surface is continuous with the connecting extension.

The mounting portion left side has a ledge. The mounting portion left side ledge has an upper surface, a lower surface, and a terminal edge protruding in an inward direction. The mounting portion right side has a ledge. The mounting portion right side ledge has an upper surface, a lower surface, and a terminal edge protruding in an inward direction.

A gap is located between the mounting portion left side ledge terminal edge and the mounting portion right side ledge terminal edge.

There is a separation located between the mounting portion left side ledge upper surface, the mounting portion right side ledge, and the inner surface of the mounting portion top.

The mounting portion right side inner surface, the mounting portion left side inner surface, the lower surface of the mounting portion left side ledge lower surface, and the mounting portion right side ledge lower surface form a bottom recess in the bottom opening of the mounting portion.

The mounting portion bottom recess and the gap mate with and slidably receiving the catch comb right component working end and the catch comb left component working end.

Another accessory which can be coupled with the catch comb is a radius roller. The radius roller has a mounting portion and a circular curved portion. The radius roller circular curved portion is continuous with the radius roller mounting portion. The radius roller circular curved portion has an outer surface and an inner surface.

The radius roller circular curved portion has a first end and a second end. The radius roller mounting portion has a generally C-shaped configuration. The radius roller mounting portion has a top and a bottom, with an opening therein. The radius roller mounting portion has a pair of generally parallel sides, being a mounting portion right side and a mounting portion left side.

The mounting portion top has an outer surface and an inner surface, with a thickness there between.

The mounting portion left side has an outer surface and an inner surface, with a thickness there between.

The mounting portion right side has an outer surface and an inner surface with a thickness there between. The mounting portion right side outer surface is continuous with the radius roller circular curved portion. The mounting portion left side outer surface is continuous with the radius roller circular curved portion.

The mounting portion left side has a ledge. The mounting portion left side ledge has an upper surface, a lower surface, and a terminal edge protruding in an inward direction.

The mounting portion right side has a ledge. The mounting portion right side ledge has an upper surface and a lower surface and a terminal edge protruding in an inward direction.

There is a gap which is located between the mounting portion left side ledge terminal edge and the mounting portion right side ledge terminal edge.

There is a separation located between the mounting portion left side ledge upper surface, the mounting portion right side ledge, the inner surface of the mounting portion top, the mounting portion right side inner surface, the mounting portion left side inner surface, the lower surface of the mounting portion left side ledge lower surface, and the mounting portion right side ledge lower surface, forming a bottom recess in the bottom opening of the mounting portion.

The mounting portion bottom recess and the gap mate with and slidably receive the catch comb right component working end and the catch comb left component working end.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved catch comb which has all of the advantages of the prior art combs for cutting hair and none of the disadvantages.

It is another object of the present invention to provide a new and improved catch comb which may be easily and efficiently manufactured and marketed.

It is further object of the present invention to provide a new and improved catch comb which is of durable and reliable constructions.

An even further object of the present invention is to provide a new and improved catch comb which is susceptible of a low cost of manufacture with regard to both materials and labor, and which accordingly is then susceptible of low prices of sale to the consuming public, thereby making such catch comb economically available to the buying public.

Even still another object of the present invention is to provide a catch comb for allowing a hair dress to easily hold hair during cutting.

Lastly, it is an object of the present invention to provide a new and improved catch comb comprising a right component and a left component which are joined together. There is a set of fixed teeth, and a set of movable teeth. The movable teeth are actuated by a grip trigger, which also has a position lock. There is also a rotatable angle indicator, so as to allow replication of angled cuts.

It should be understood that while the above-stated objects are goals which are sought to be achieved, such objects should not be construed as limiting or diminishing the scope of the claims herein made.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
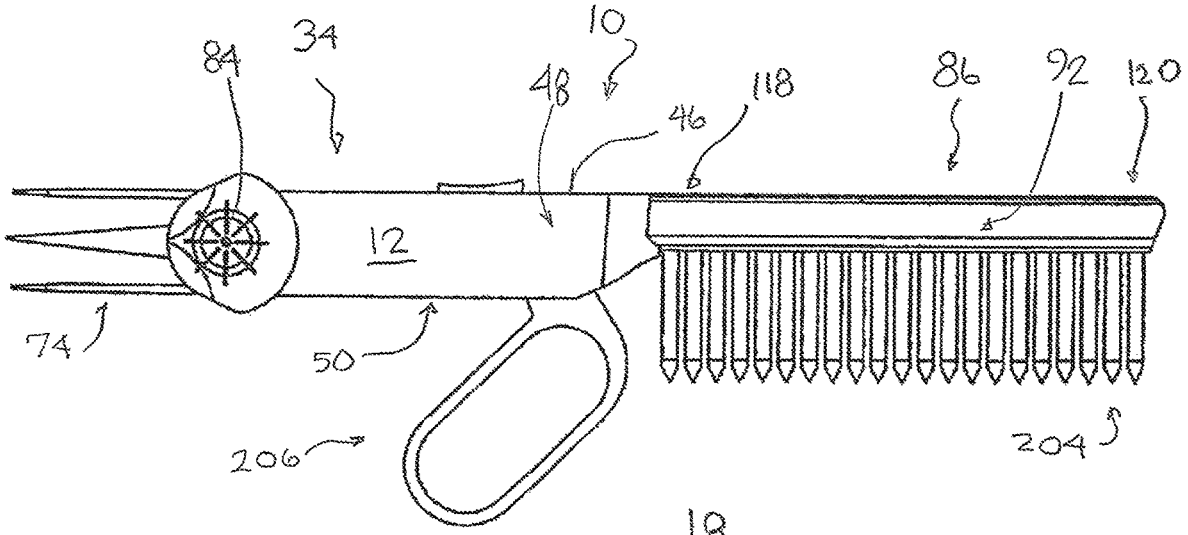
FIG. 1 is a right side elevational view of the catch comb.
Figure 2:
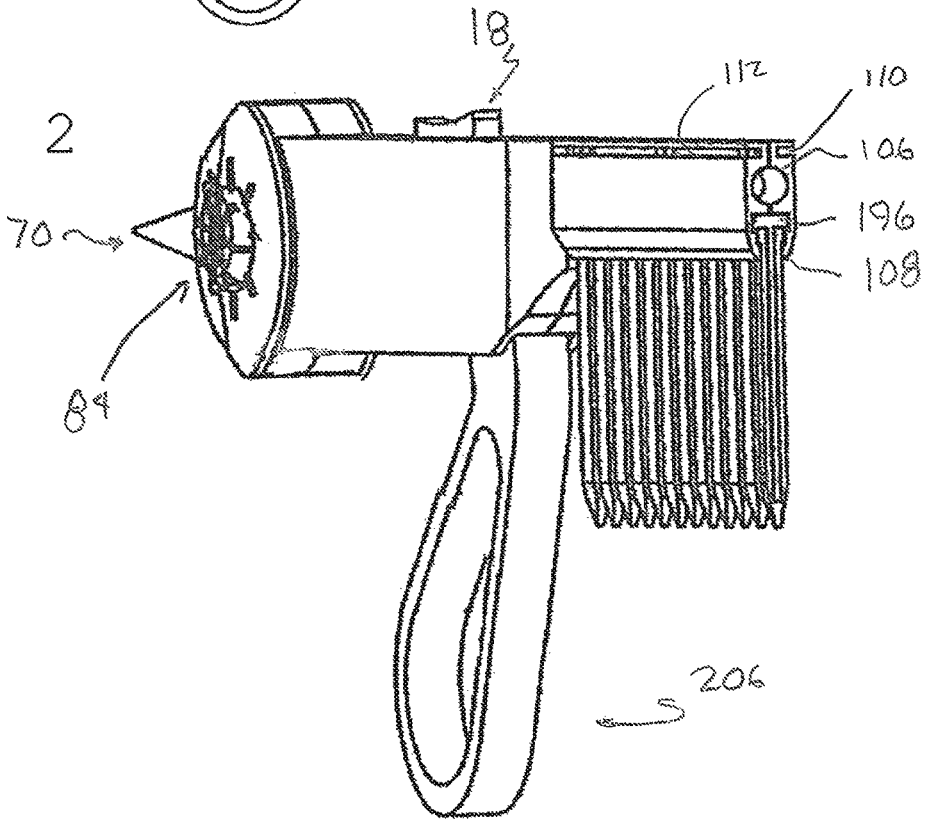
FIG. 2 is a right side perspective view, with a section cut through the distal end of the comb.
Figure 3:
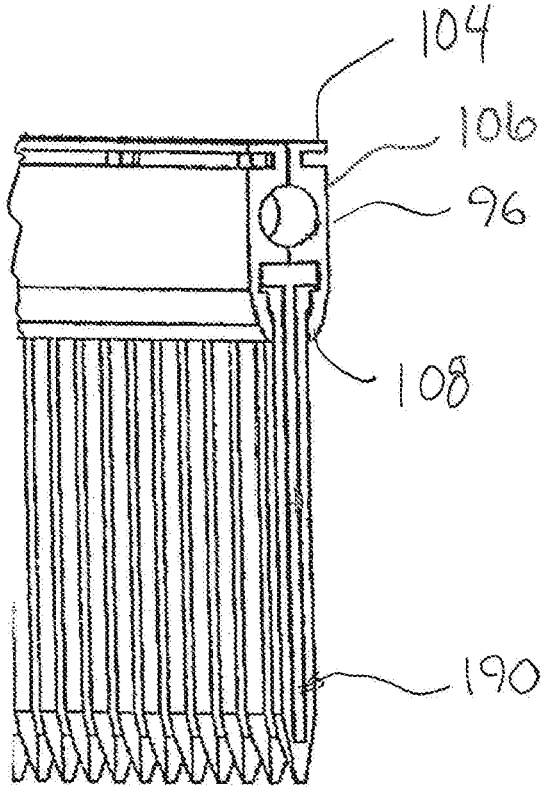
FIG. 3 is a vertical cross section of the distal end of the comb, showing the orientation of the fixed and movable gripper combs.
Figure 4:
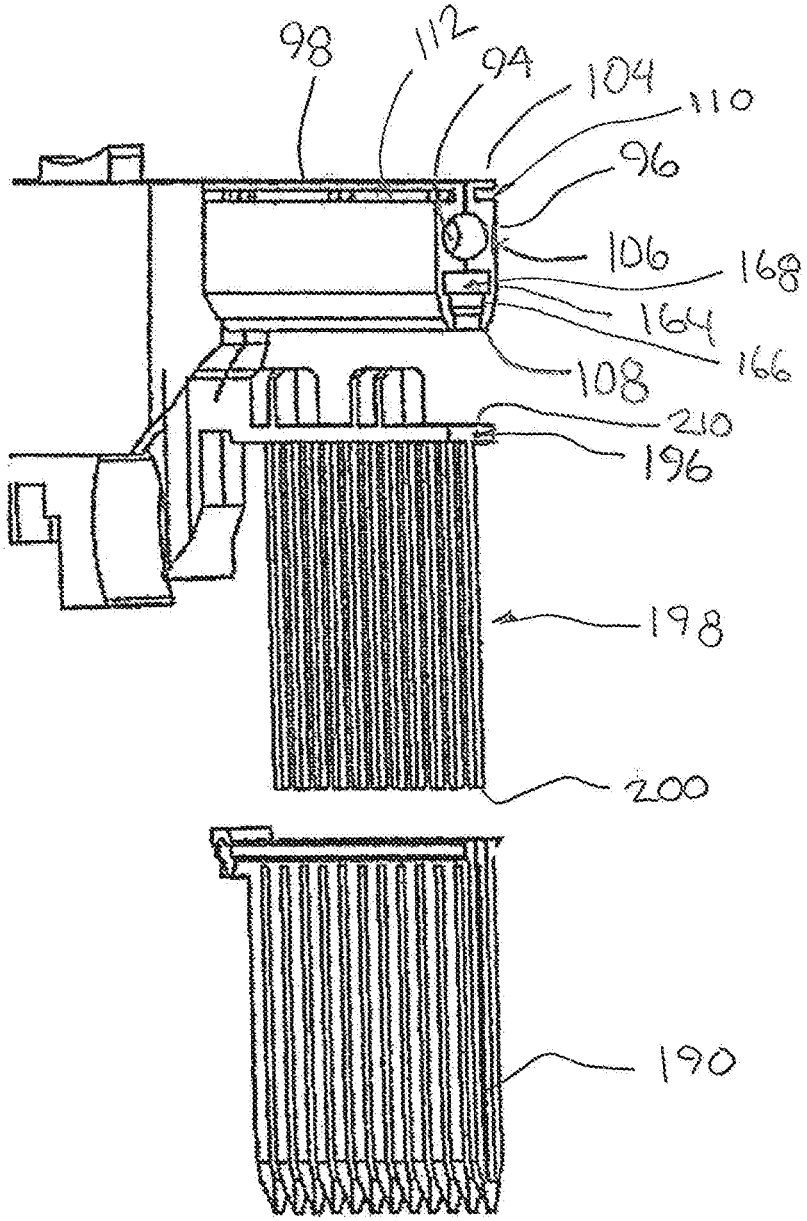
FIG. 4 is a vertical cross section, exploded view, showing the fixed comb, and the movable gripper comb.
Figure 5:
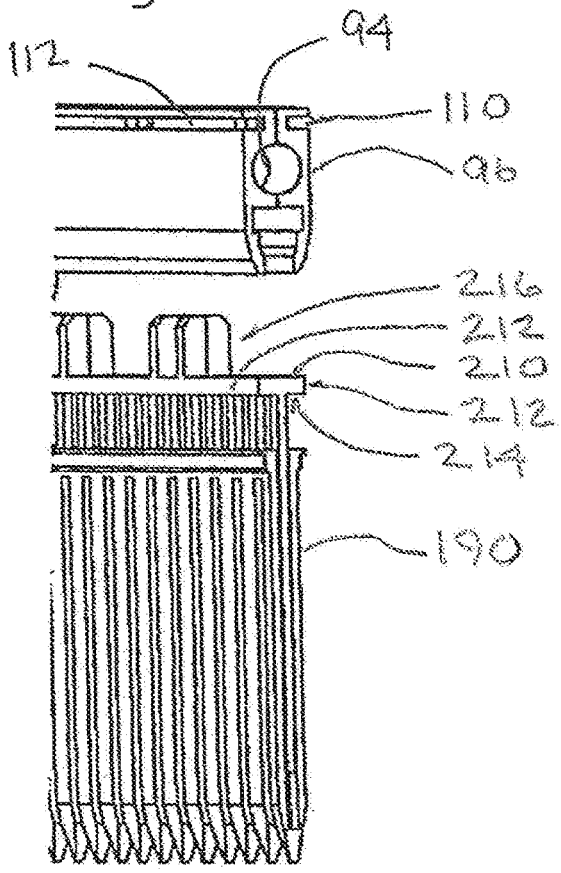
FIG. 5 is vertical cross section, partially exploded view showing the fixed comb and the movable gripper comb in a relation wherein the movable gripper comb is partially inserted into the fixed comb.
Figure 6:
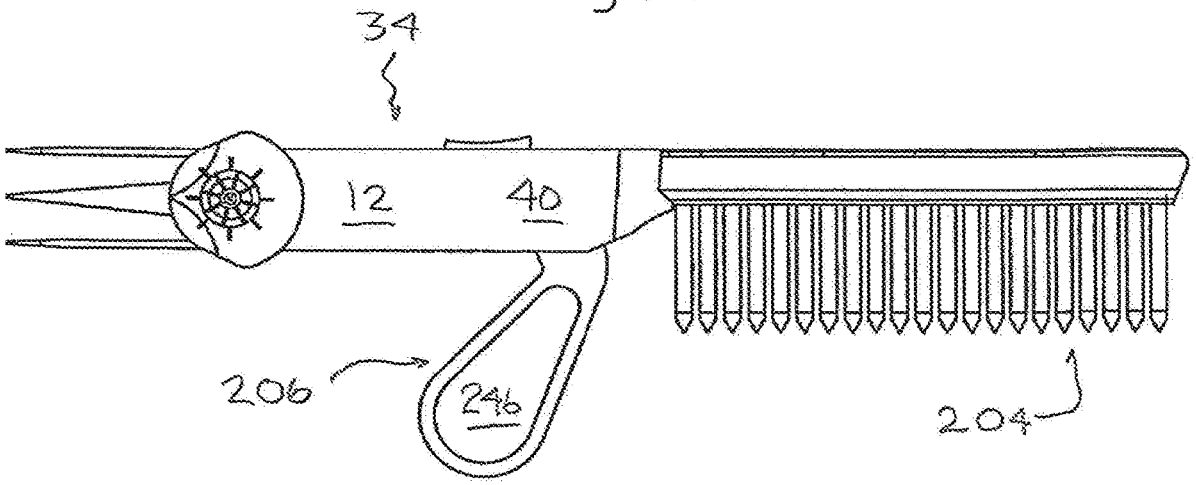
FIG. 6 is a right side elevational view.
Figure 7:
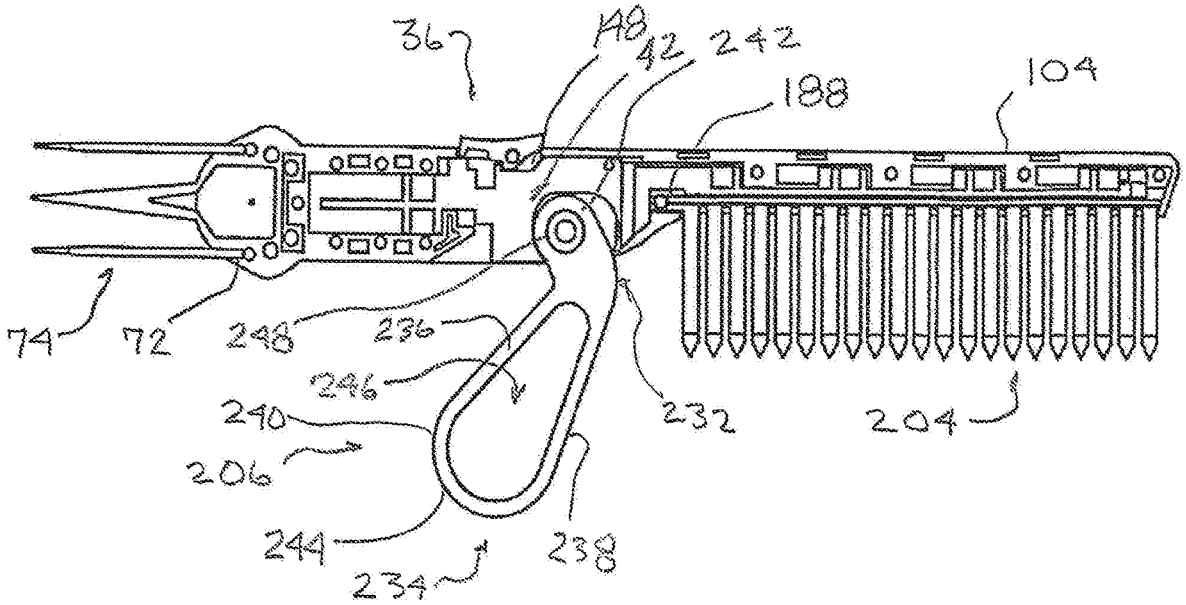
FIG. 7 is a cross section view, showing inner surface of the left component.
Figure 8:
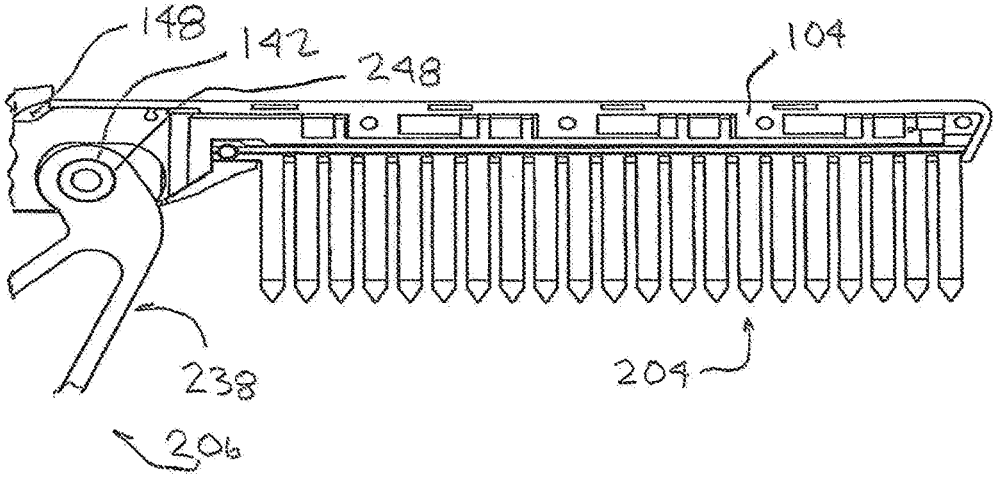
FIG. 8 is a partial cross sectional view elevational view of the distal portion of the inner surface of the left component.
Figure 9:
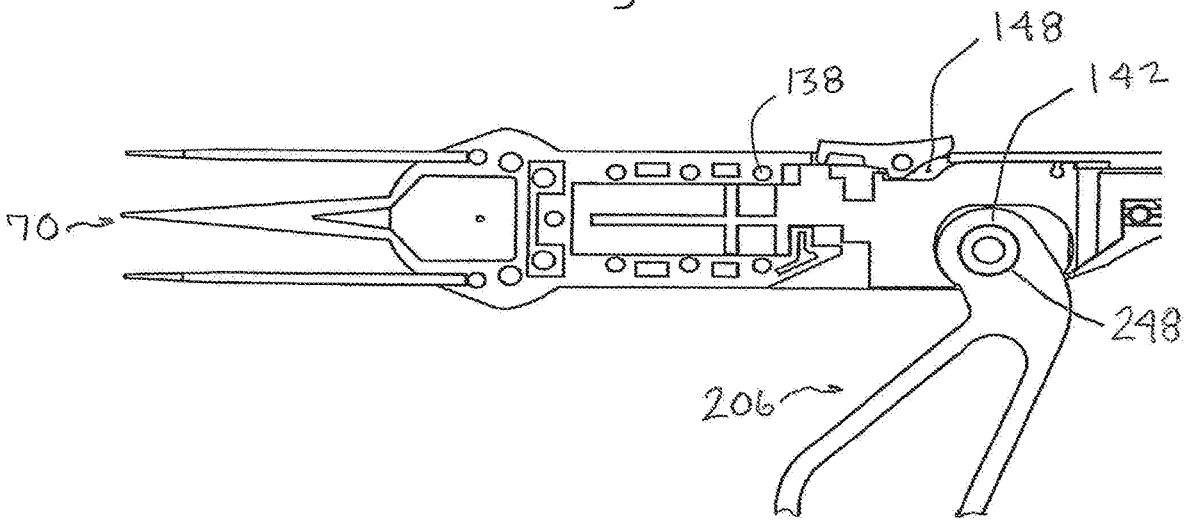
FIG. 9 is a partial cross sectional view elevational view of the proximal portion of the inner surface of the left component.
Figure 10:
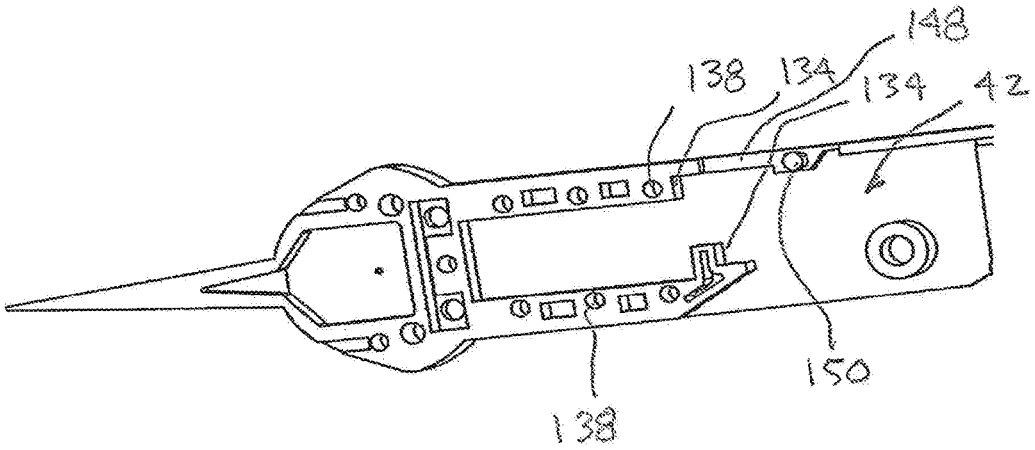
FIG. 10 is a close up, partial perspective view of the proximal left component, inner surface.
Figure 11:
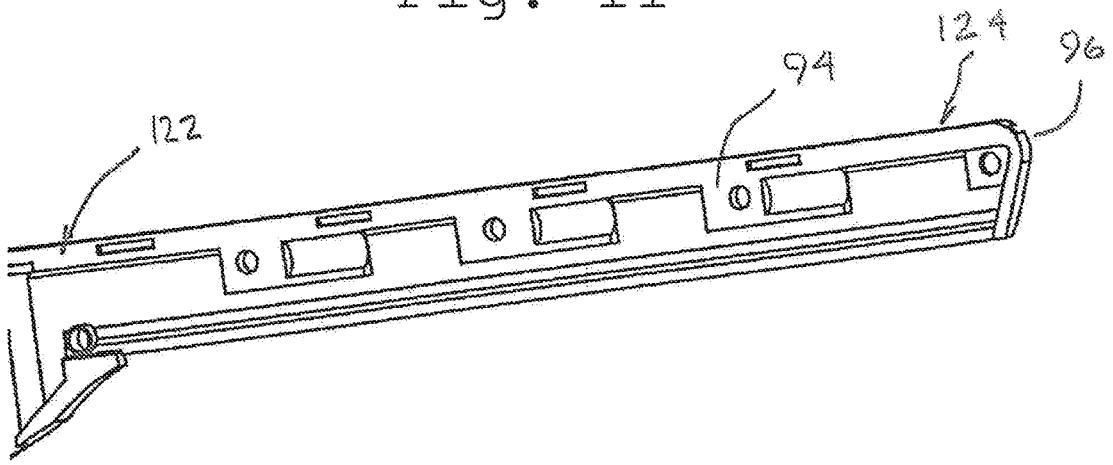
FIG. 11 is a close up, partial perspective view of the distal left component, inner surface.
Figure 12:
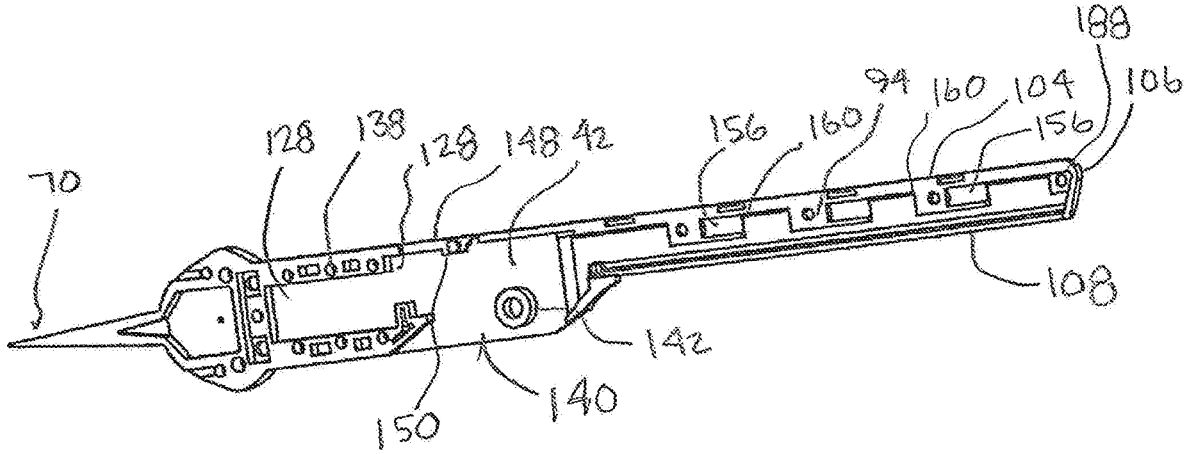
FIG. 12 is a close up, perspective view showing the left component, inner surface.
Figure 13:
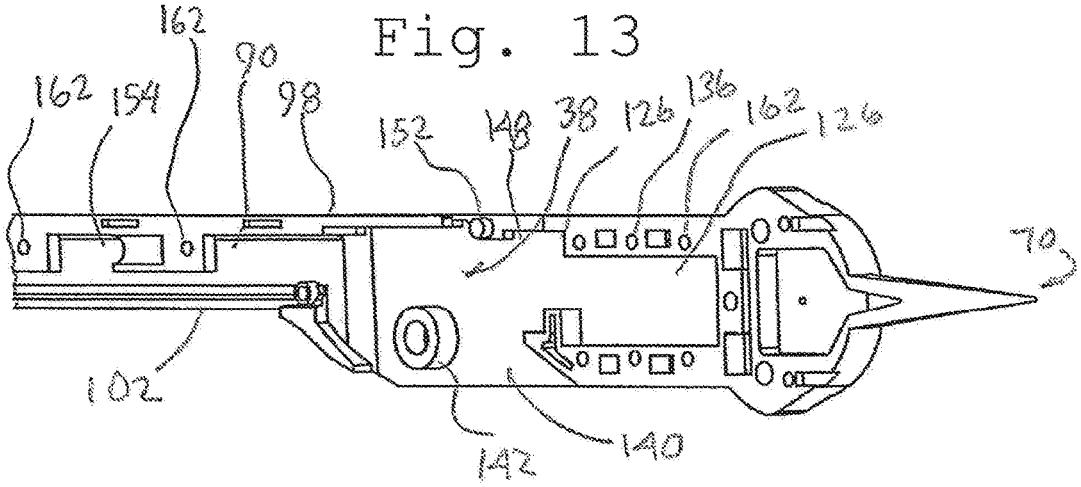
FIG. 13 is a close up, partial perspective view of the proximal right component, inner surface.
Figure 14:
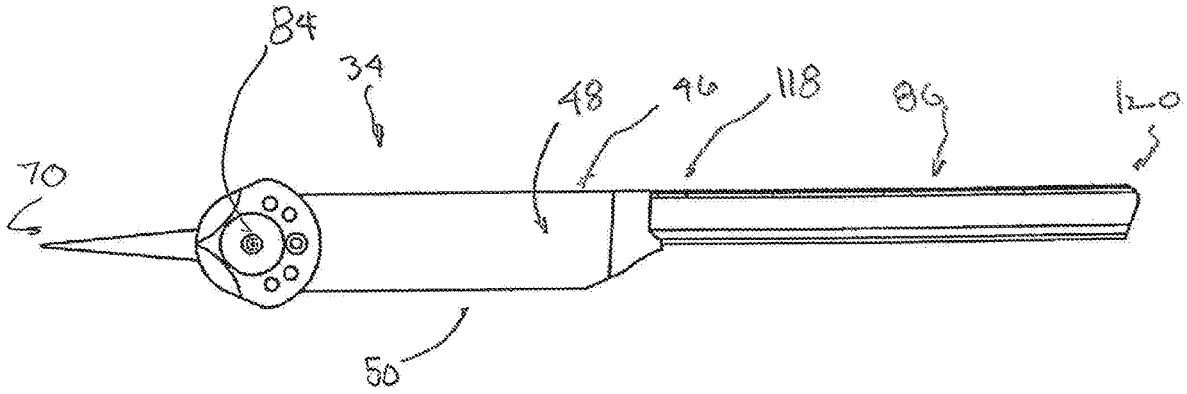
FIG. 14 is an elevational view of the right component, outer surface.
Figure 15:
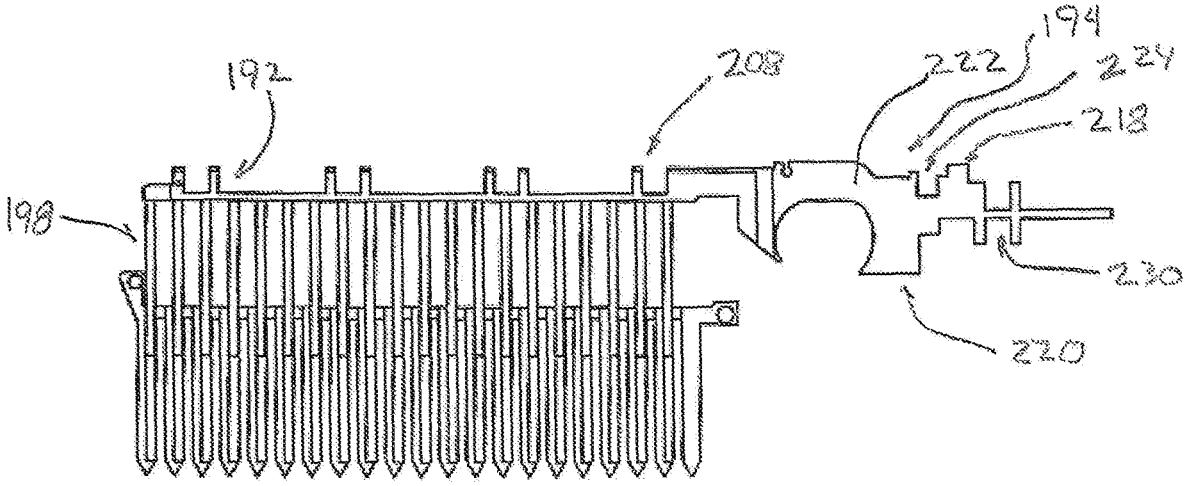
FIG. 15 is a side elevational, partially exploded view of the fixed comb and the movable gripper comb.
Figure 16:
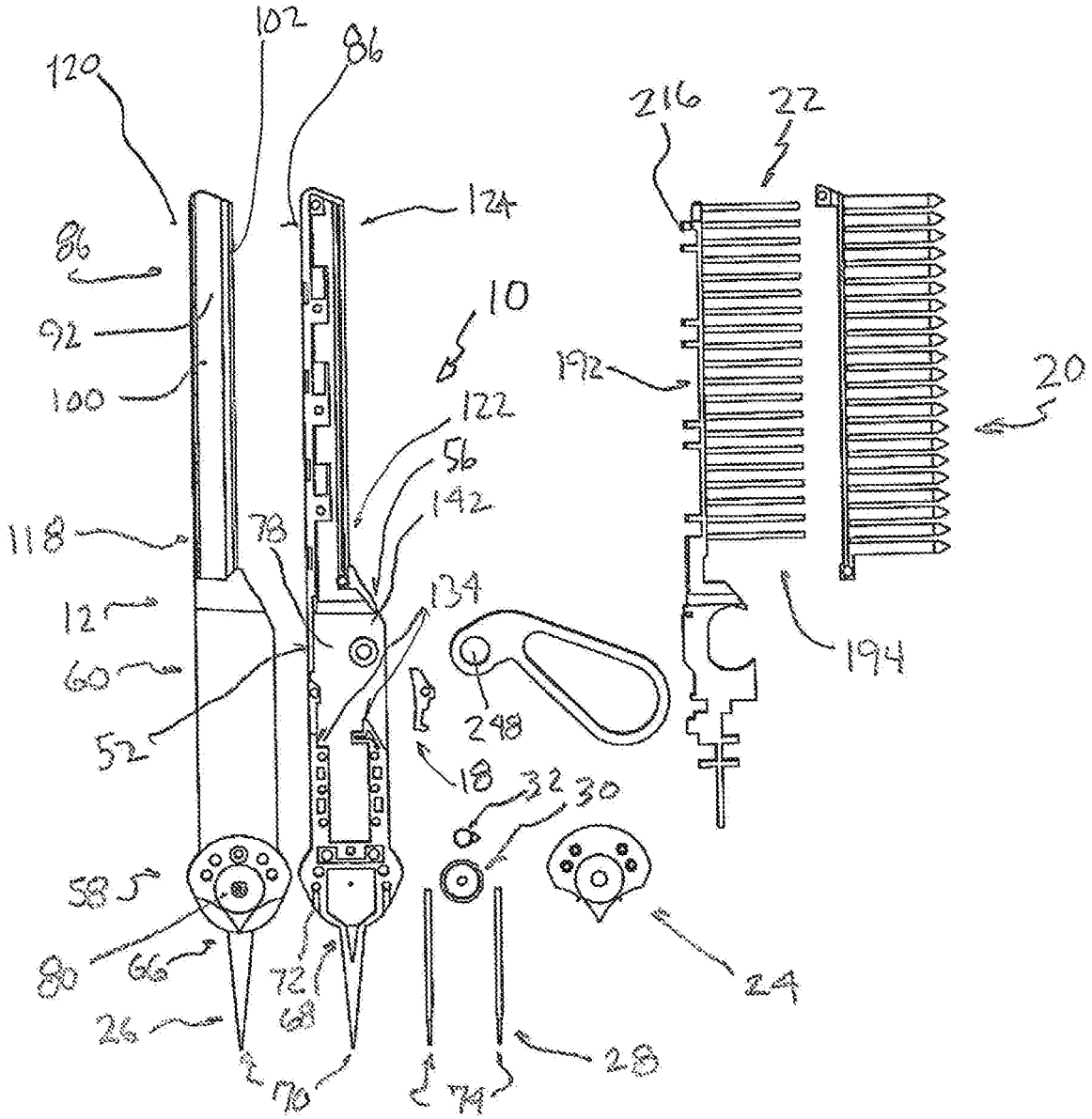
FIG. 16 is an exploded view of the Catch Comb.
Figure 17:
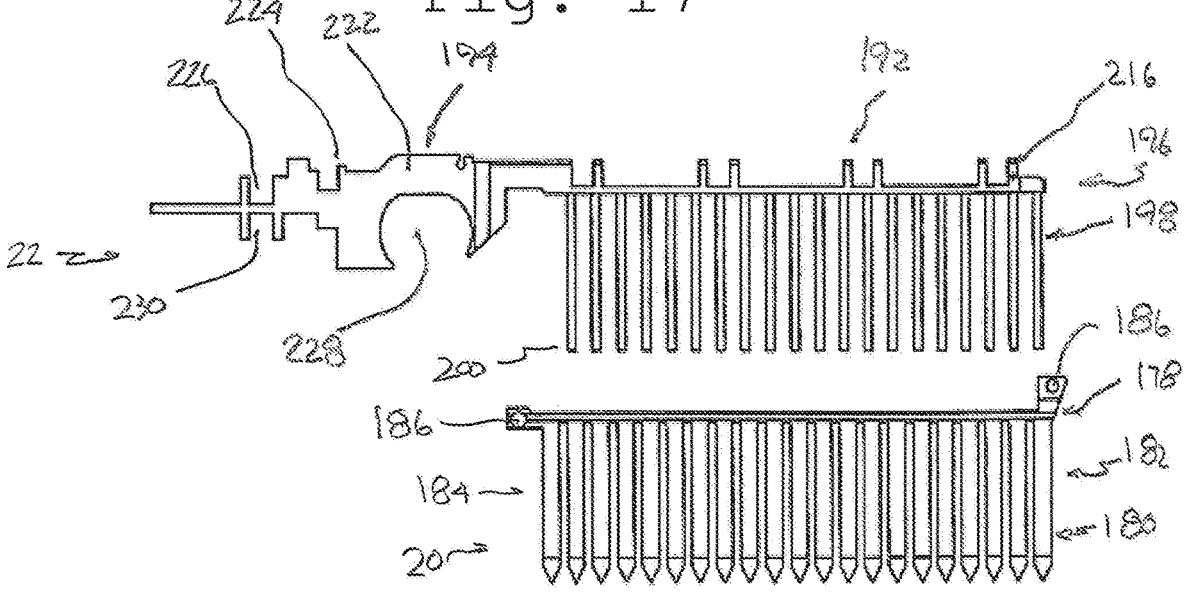
FIG. 17 is a side elevational, exploded view of the fixed comb and the movable gripper comb.
Figure 18:
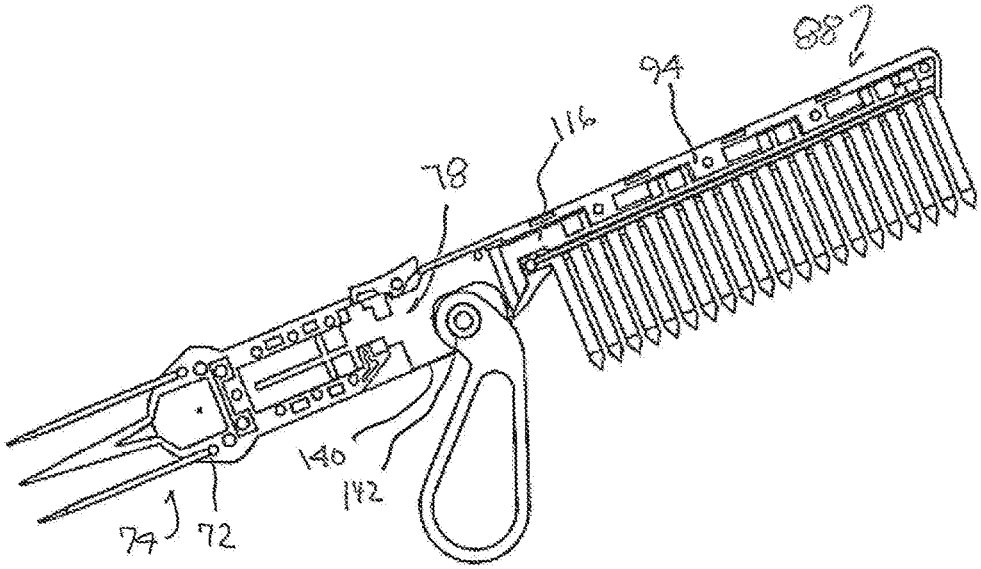
FIG. 18 is a cross sectional view, showing the inner surface of the left component, showing the gripper trigger in position.
Figure 19:
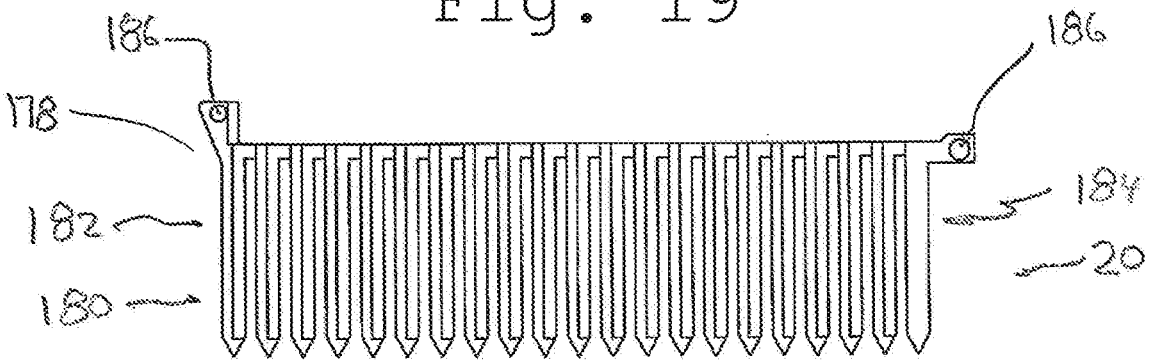
FIG. 19 is a side elevational view of the fixed comb.
Figure 20:
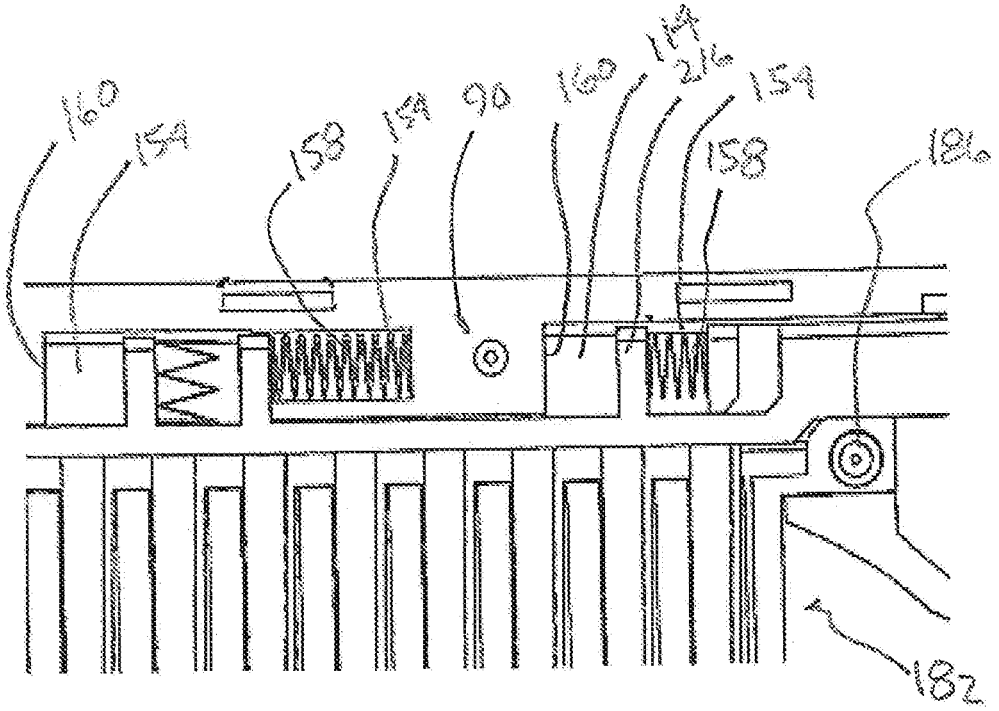
FIG. 20 is a partial cross sectional view of the inner surface of the right component.
Figure 21:
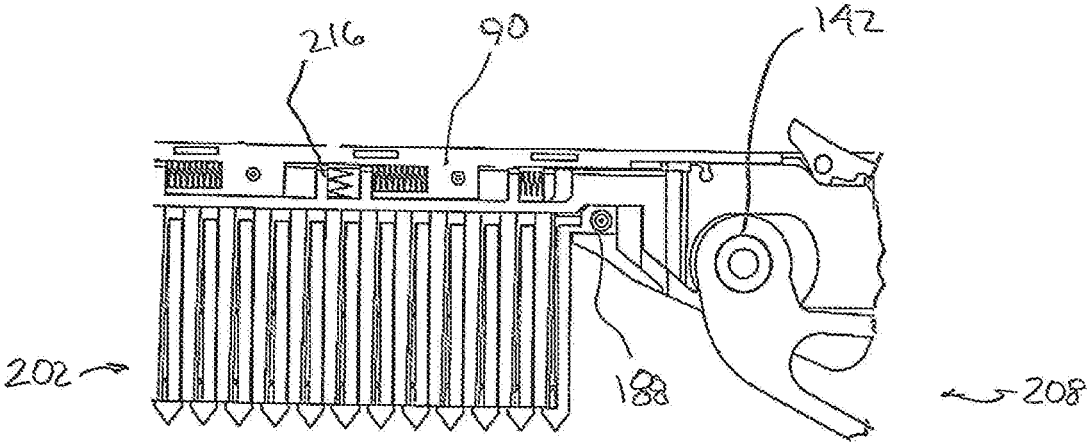
FIG. 21 is a partial cross sectional view of the catch comb inner surface of the distal right component, in the engaged position. Note the position of the gripper trigger and the movable gripper comb.
Figure 22:
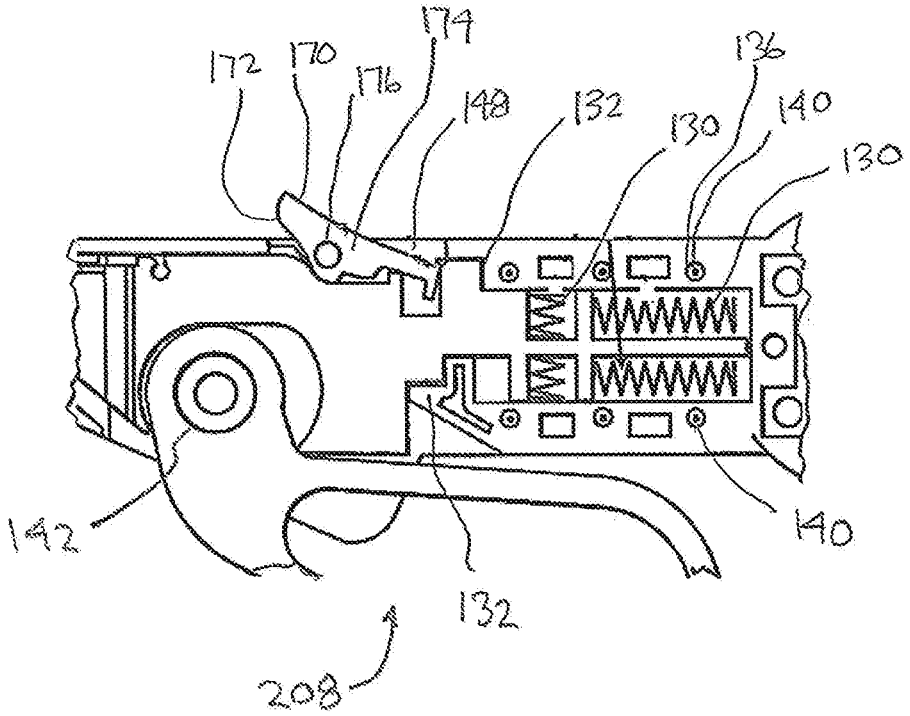
FIG. 22 is a partial cross sectional view of the catch comb inner surface of the proximal right component, in the engaged position. Note the position of the gripper trigger and the movable gripper comb. Note the gripper trigger lock is engaged, holding the movable gripper comb in the engaged position.
Figure 23:
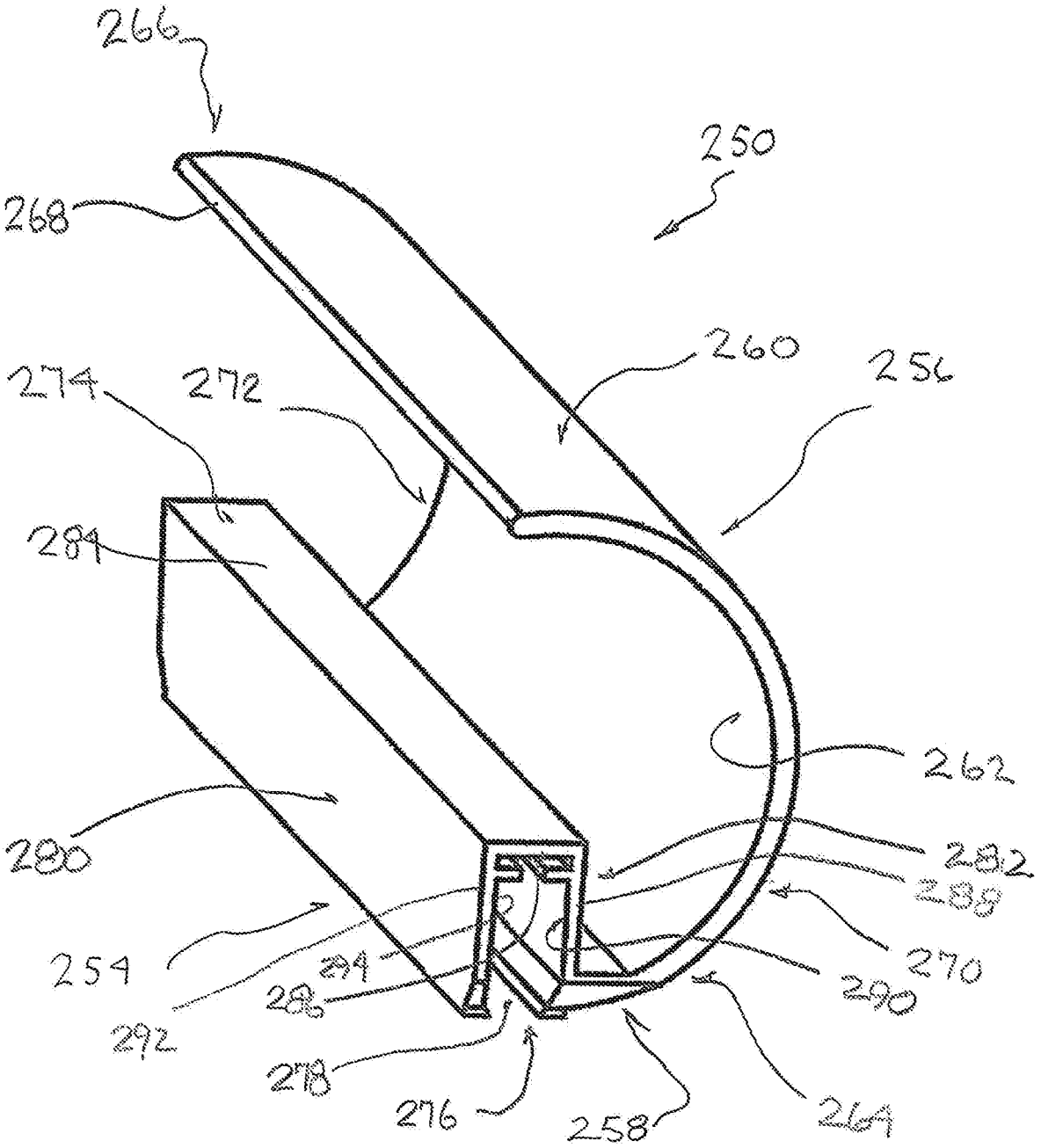
FIG. 23 is a perspective view of the radius slider.
Figure 23A:
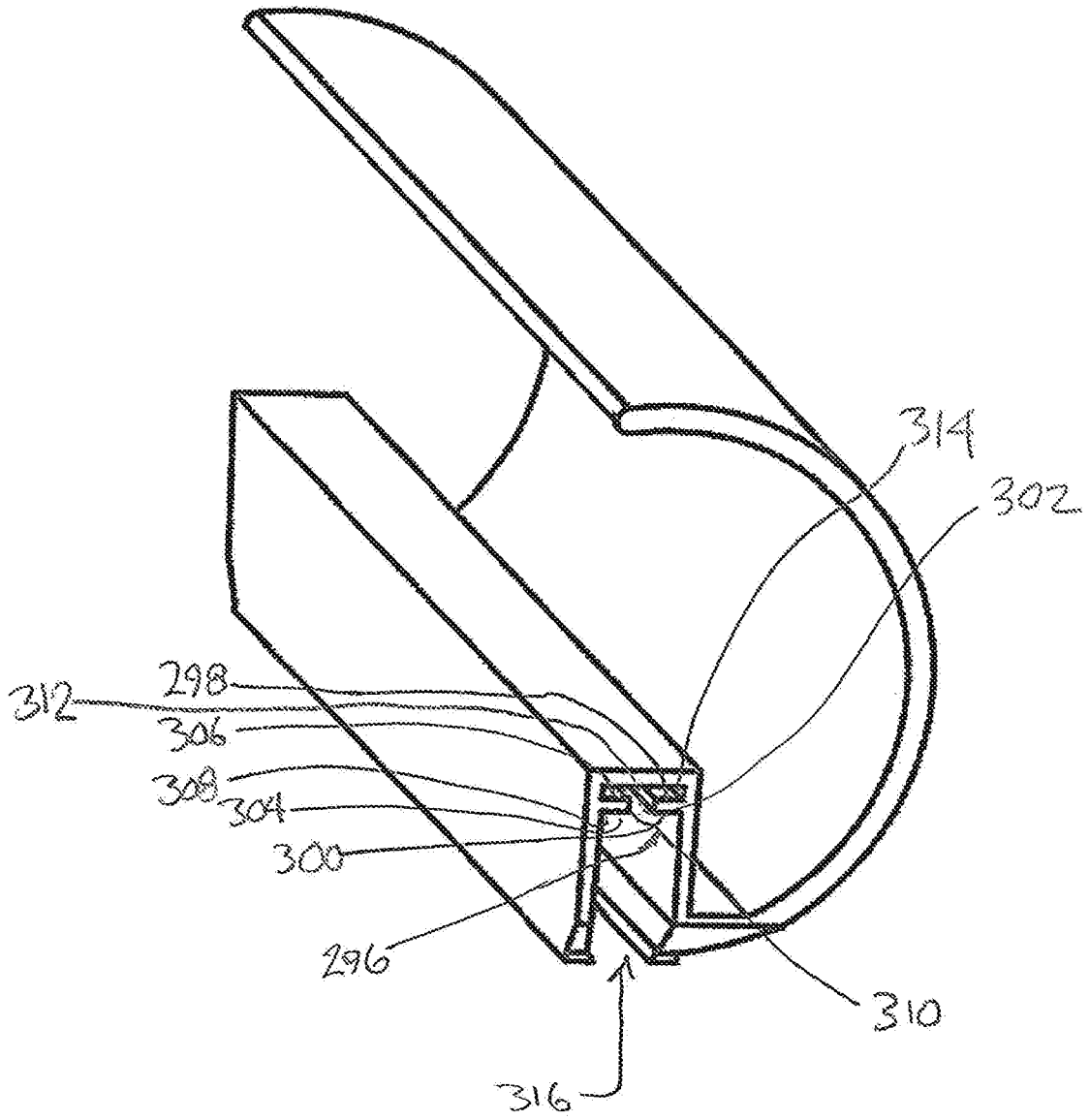
FIG. 23A is a perspective view of the radius slider.
Figure 24:
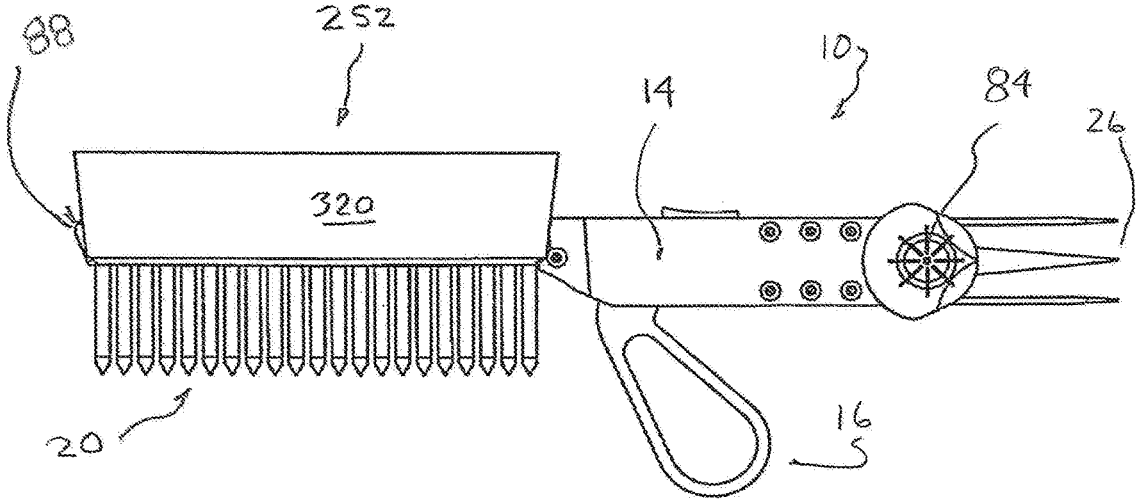
FIG. 24 is a left side elevational view of the catch comb with a roller slider in position on the working end of the catch comb.
Figure 25:
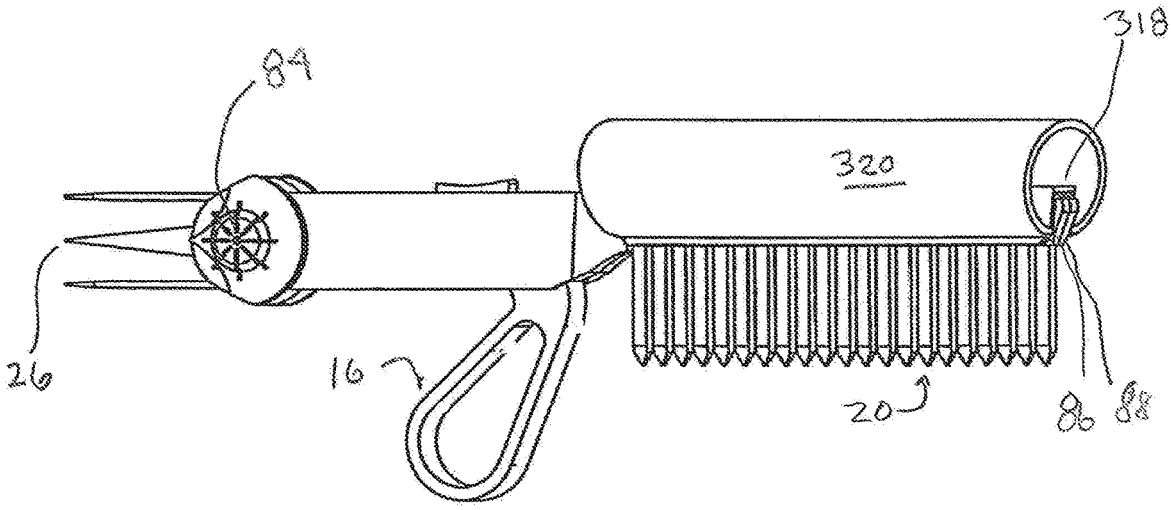
FIG. 25 is a perspective view of the catch comb from the right side, with a roller slider in position on the working end of the catch comb.
Figure 26:
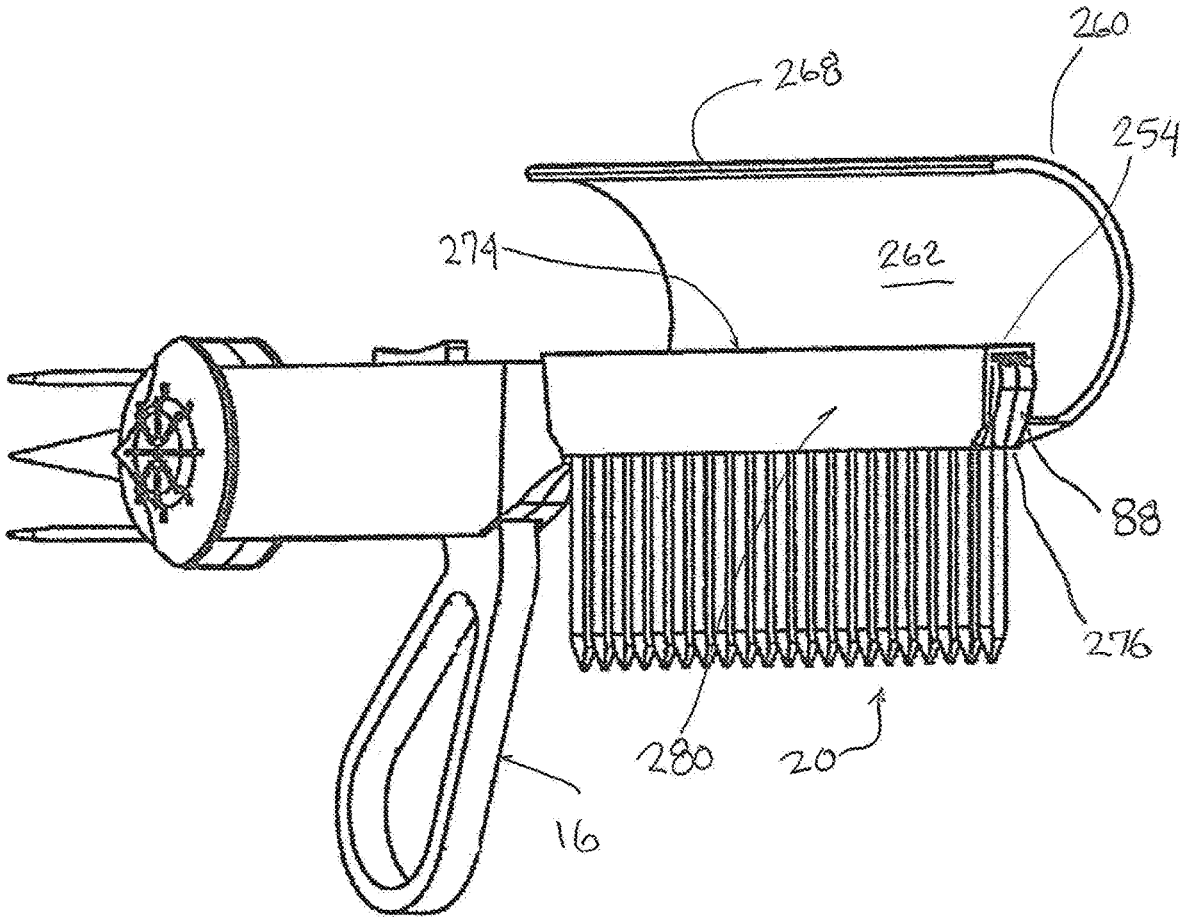
FIG. 26 is a perspective view of the catch comb from the right side, with a radius slider in position on the working end of the catch comb.
Figure 27:
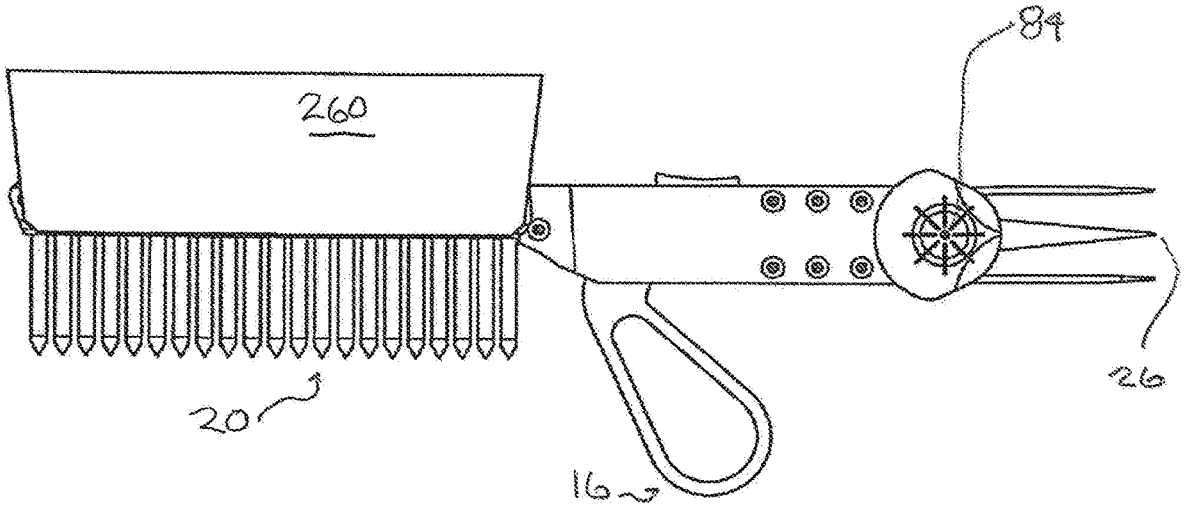
FIG. 27 is a left side elevational view of the catch comb with a radius slider in position on the working end of the catch comb.
Figure 28:
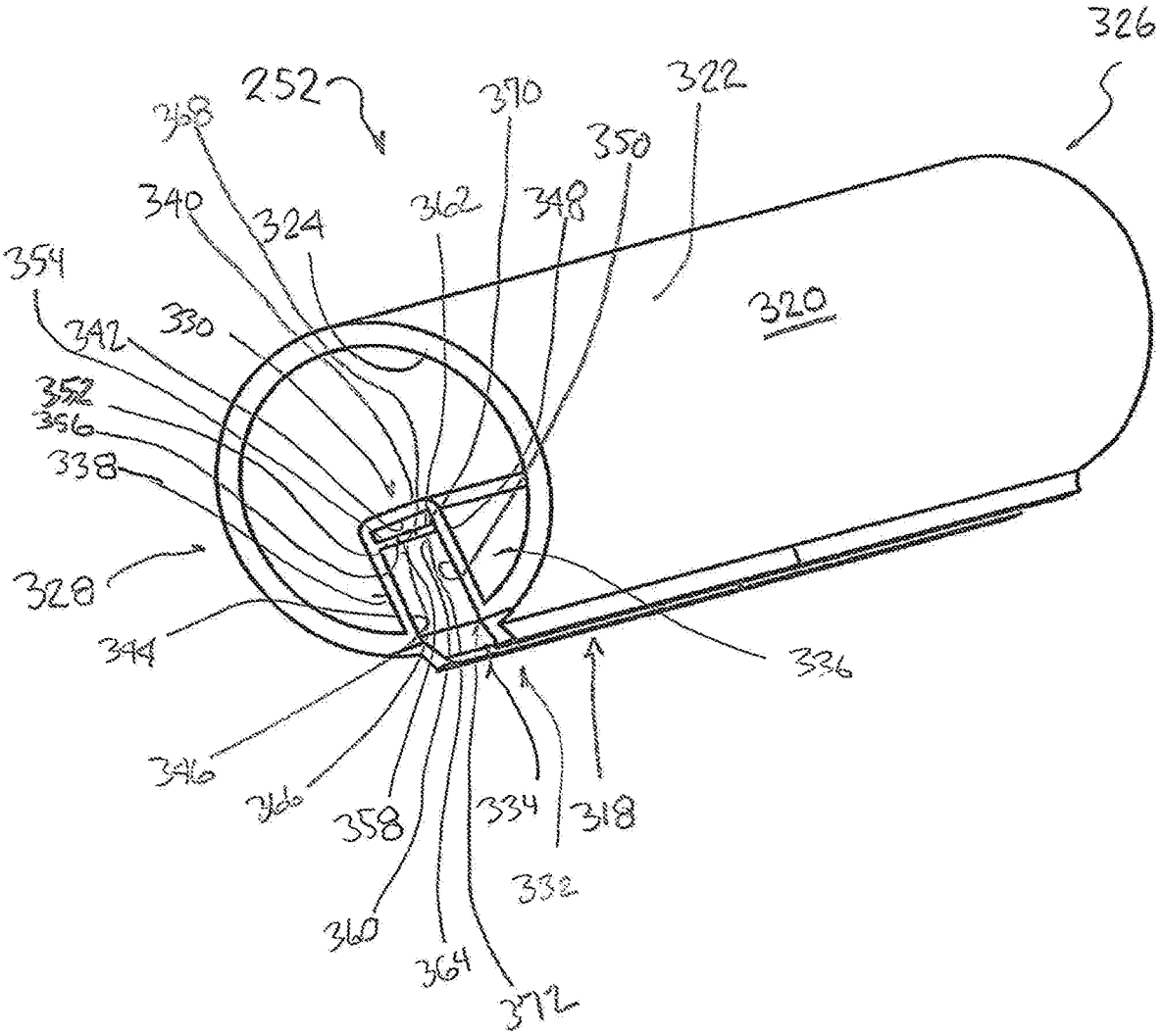
FIG. 28 is a perspective view of the roller slider.

With reference now to the drawings, and in particular to FIG. 1 thereof, the preferred embodiment of the new and improved catch comb embodying the principles and concepts of the present invention and generally designated by the reference numeral 10 will be described.

The present invention, the catch comb 10 is comprised of a plurality of components. Such components in their broadest context include a right component, a left component, a fixed comb and a movable gripper comb. Such components are individually configured and correlated with respect to each other so as to attain the desired objective.

Herein described is a catch comb 10 which comprises several components, in combination.

There are a pair of components, being a right component 12, a left component 14, a grip trigger 16, a grip trigger lock 18, a fixed comb 20, a movable gripper comb 22, and a rotatable angle indicator 24. There is also an end pick 26, a pair of removable picks 28. The rotatable angle indicator has a fixed base 30 and a rotatable indicator 32. The catch comb is fabricated of a rigid material.

The right component and the left component each have a handling end and a working end. The handling end of the right component 34 and the handling end of the left component 36 each have a generally rectilinear configuration, with there being a right component inner surface 38 and a right component outer surface 40. There is a left component inner surface 42 and a left component outer surface 44. The outer surface of the right component handling end comprises a top surface 46, a side surface 48, and a bottom surface 50. The outer surface of the left component handling end comprises a top surface 52, a side surface 54, and a bottom surface 56.

The handling end of the right component has a proximal portion 58 and a distal portion 60. The handling end of the left component has a proximal portion 62 and a distal portion 64. The proximal portions and distal portions of the handling ends of the right and left components each lie on a common axis. The proximal portion and the distal portion of the right component handling end are continuous with each other. The proximal portion and the distal portion of the left component handling end are continuous with each other.

The proximal portion of the right component handling end has a terminus 66, and the proximal portion of the handling end left component has a terminus 68.

The terminus of the right component handling end and the terminus of the left component handling end are joined together, and together the handling ends comprise at least one fixed hair pick 70. The at least one fixed hair pick protrudes proximally from the terminus of the left component handling end proximal portion and right component handling end proximal portion. The left component handling end proximal portion and the right component handling end proximal portion each have a plurality of removable hair pick recesses 72 therein, with the hair pick recesses each having an associated removable hair pick 74. The removable hair picks are inserted into the hair pick recesses. The hair picks protrude proximally from the terminus of the handling end proximal portion of both the right component and the left component.

The handling end inner surface of the right component has a recess 76 therein. The handling end inner surface of the left component has a recess 78 therein.

The right component handling end outer side surface has a rotatable angle indicator recess 80 therein. The left component handling end outer side surface has a rotatable angle indicator recess 82 therein. Each rotatable angle indicator recess has an associated rotatable angle indicator. The rotatable angle indicator has an associated rotatable angle indicator pin 84.

The right component working end 86 and the left component working end 88 are oriented along the common axis. The right component working end and the left component working end each have a generally rectilinear configuration.

The right component working end has an inner surface 90 and an outer surface 92. The left component working end has an inner surface 94 and an outer surface 96. The right component working end outer surface comprises a top surface 98, a side surface 100, and a bottom surface 102. The left component working end outer surface comprises a top surface 104, a side surface 106, and a bottom surface 108.

The left component working end outer surface has an outer surface recess 110 therein. The right component working end outer surface each has an outer surface recess 112 therein.

The right component working end inner surface has a recess 114 therein. The left component working end inner surface has a recess 116 therein.

The right component working end has a proximal portion 118 and a distal portion 120. The left component working end has a proximal portion 122 and a distal portion 124. The right component working end proximal portion is continuous with the distal portion of the right component handling end. The left component working end proximal portion is continuous with the distal portion of the left component handling end.

The recess of the right component handling end has a plurality of spring nests 126 therein. The recess of the left component handling end has a plurality of spring nests 128 therein. Each of the spring nests of the handling end of the right component and each of the spring nests of the handling end of the left component has an associated spring 130.

The recess of the right component handling end has a plurality of handling end comb travel stops 132. The recess of the left component handling end has a plurality of handling end comb travel stops 134. The right component handling end has a plurality of fastener holes 136 therein. The left component handling end has a plurality of fastener protuberances 138 therein. Each of the fastener holes of the right component handling end mates with, and receives each of left component handling end protuberances so as to lock the left component and the right component together.

The bottom surface of the left component handling end and the bottom surface of the right component handling end each has an stepped grip trigger recess 140 therein.

The inner surface of the left component handling end and inner surface of the right component handling end each has a trigger pin boss 142.

The top surface of the left component handling end and the top surface of the right component handling end each has a grip trigger lock recess therein 148. The left component handling end, top surface trigger lock recess has a grip trigger lock retaining pin 150 protruding therein. The right component handling end, top surface trigger lock recess has a grip trigger lock retaining pin hole 152 therein. The trigger lock retaining pin is sized to mate with the trigger lock retaining pin hole so as to rotatably hold the trigger lock.

The recess of the right component working end has a plurality of spring nests 154 therein. The recess of the left component working end has a plurality of spring nests 156 therein. The spring nests of the working end of the right component and the spring nests of the working end of the left component each has an associated spring 158.

The recesses of both the right component working end and the left component working end have a plurality of comb travel stops 160 therein. The right component working end has a plurality of fastener holes 162 therein. The left component working end has a plurality of fastener pins therein. The fastener holes of the right component working end and the fastener pins of the left component working end are configured to be mated together so as to hold the right component and the left component together.

The bottom surface of the right component working end and the bottom surface of the left component working end are coupled to form a stepped slot 164 on the bottom surfaces of the coupled right component working end and left component working end. The working end bottom surface stepped slot has a first step 166 and a second step 168. The working end bottom surface stepped slot first step and the working end bottom surface stepped slot second step each having a side to side distance, with the side to side distance of the second step being greater than the side to side distance of the first step. The working end bottom surface stepped slot second step is greater than the working end bottom surface stepped slot first step.

The grip trigger lock has an upper surface 170 having a generally planar configuration, a lower surface 172 having a stepped configuration, and a pair parallel, planar side surfaces 174. The side surfaces each have a grip trigger lock retaining pin hole 176 there through.

The fixed comb has a generally rectilinear upper mounting portion 178 and a multi toothed lower hair portion 180. The upper mounting portion has an distal end 182 and a proximal end 184. The distal end and the proximal end of the upper mounting portion of the fixed comb each have a mounting pin hole 186 there through.

Each of the distal ends of the fixed comb and the proximal end upper mounting portion mounting pin holes have at least one associated mounting pin 188.

The fixed comb upper mounting portion is sized to be fixedly held within the first step of the right component bottom surface stepped slot stepped slot. The fixed comb upper mounting portion is also sized to be fixedly held with the first step of the left component bottom surface stepped slot. Each of the teeth of the fixed comb multi toothed lower hair portion have a movable gripper comb groove 190 there through.

The movable gripper comb has a distal portion 192 and a proximal portion 194. The distal portion of the movable gripper comb and the proximal portion of the movable gripper comb are continuous with each other.

The distal portion of the movable gripper comb has an upper engaging portion 196 and a multi toothed lower portion 198. The movable gripper comb multi toothed lower portion teeth each have a proximal surface, a distal surface, and a pair of side surfaces, and a terminus 200. Each of the teeth of the movable gripper comb lower portion are configured to be slidably located within the movable gripper comb groove of the fixed comb multi toothed lower hair portion.

The movable gripper comb teeth each have an engaged location 202 and the movable gripper comb teeth each have a stored location 204. The movable gripper comb teeth are in the stored location when each tooth of the movable gripper comb is contained with the movable gripper comb groove of the fixed comb multi toothed lower hair portion.

The movable gripper comb teeth are in the engaged location when each movable gripper comb tooth is outside of the movable gripper comb groove of the fixed comb multi toothed lower hair portion. In the engaged location, the teeth of the movable gripper comb press the hair which is between the teeth of the fixed comb, against an adjacent tooth of the fixed comb. In the stored location, the gripper trigger is at a position away from the handle 206. In the engaged location, the gripper trigger is at a position adjacent the handle 208.

The upper engaging portion of the distal portion of the movable gripper comb has a generally T-shaped configuration, with an upper surface 210, a pair of parallel side surfaces 212, and a lower surface 214.

The lower surface of the upper engaging portion of the distal portion of the movable gripper comb is continuous with the multi toothed lower portion of the distal portion of the movable gripper comb.

The upper engaging portion of the distal portion of the movable gripper comb having a plurality of upwardly disposed spring contacting extensions 216. Each of the upwardly disposed spring contacting extensions has a generally rectilinear configuration.

The proximal portion of the movable gripper comb has an upper surface 218, a lower surface 220, and a pair of generally parallel side surfaces 222. The upper surface of the proximal portion of the movable gripper comb has grip trigger upward extension 224 and a plurality of spring recesses 226 therein. The lower surface of the proximal portion of the movable gripper comb has a grip trigger cam lobe cutout 228 and a plurality of spring recesses 230 therein.

The grip trigger has an upper end 232 and a lower end 234. The grip trigger has a pair of generally parallel side surfaces 236, a front surface 238, a rear surface 240, an upper surface 242, and a lower surface 244. The lower end of the grip trigger has a finger aperture 246 there through. The upper end of the grip trigger has a trigger pin boss aperture 248 there through with the trigger pin boss aperture sized to rotatably mount the grip trigger on the trigger pin boss.

In operation, a user, such as a hair dresser or barber will hold the catch comb in the user's hand. A customer will be in position and the user will comb through the customer's hair, to a point where the user desires to make a cut. At that point, the user will squeeze the gripper trigger, causing the movable gripper comb to move from the stored location to the operational location, wherein the hair within the comb is then pinched between the fixed comb and the movable gripper comb. The user may then rotate the catch comb so that the lower surface of the catch comb is oriented downward, so that the rotatable angle indicator may be read. This procedure allows the user to copy the same angle of cut on both sides of the customer's head, so as to create a symmetric cut on both sides. In some applications the user may wish to make the cuts on either side of the head at different angles, to give a different appearance. The use of the rotatable angle indicator will allow the user to reproduce angled cuts by noting the angle of the catch comb relative to the coward location.

The catch comb may also use accessories, such as the radius slider 250 and the radius roller 252.

The radius slider has a mounting portion 254, a semicircular curved portion 256, and a connecting extension 258. The radius slider connecting extension is continuous with the radius slider mounting portion.

The radius slider semicircular portion has an outer surface 260, an inner surface 262, a proximal end 264, and a distal end 266. The distal end of the semicircular portion of the radius slider has a terminal edge 268.

The radius slider semicircular portion has a first end 270 and a second end 272. The proximal end of the semicircular portion of the radius slider is continuous with the connecting extension.

The radius slider mounting portion has a generally C-shaped configuration, having a top 274 and a bottom 276, with an opening 278 therein. There is a pair of generally parallel sides, being a mounting portion right side 280 and a mounting portion left side 282. The mounting portion top has an outer surface 284 and an inner surface 286, with a thickness there between. The mounting portion left side has an outer surface 288 and an inner surface 290, with a thickness there between.

The mounting portion right side has an outer surface 292 and an inner surface 294 with a thickness there between. The mounting portion right side outer surface is continuous with the connecting extension.

The mounting portion left side has a ledge 296. The mounting portion left side ledge has an upper surface 298, a lower surface 300, and a terminal edge 302 protruding in an inward direction.

The mounting portion right side has a ledge 304. The mounting portion right side ledge has an upper surface 306, a lower surface 308, and a terminal edge 310 protruding in an inward direction.

A gap 312 is located between the mounting portion left side ledge terminal edge and the mounting portion right side ledge terminal edge.

There is a separation 314 located between the mounting portion left side ledge upper surface, the mounting portion right side ledge, and the inner surface of the mounting portion top.

The mounting portion right side inner surface, the mounting portion left side inner surface, the lower surface of the mounting portion left side ledge lower surface, and the mounting portion right side ledge lower surface form a bottom recess 316 in the bottom opening of the mounting portion.

The mounting portion bottom recess and the gap mate with and slidably receiving the catch comb right component working end and the catch comb left component working end.

Another accessory which can be coupled with the catch comb is the radius roller. The radius roller has a mounting portion 318 and a circular curved portion 320. The radius roller circular curved portion is continuous with the radius roller mounting portion. The radius roller circular curved portion has an outer surface 322 and an inner surface 324.

The radius roller circular curved portion has a first end 326 and a second end 328.

The radius roller mounting portion has a generally C-shaped configuration. The radius roller mounting portion has a top 330 and a bottom 332, with an opening 334 therein. The radius roller mounting portion has a pair of generally parallel sides, being a mounting portion right side 336 and a mounting portion left side 338.

The mounting portion top has an outer surface 340 and an inner surface 342, with a thickness there between.

The mounting portion left side has an outer surface 344 and an inner surface 346, with a thickness there between.

The mounting portion right side has an outer surface 348 and an inner surface 350 with a thickness there between. The mounting portion right side outer surface is continuous with the radius roller circular curved portion. The mounting portion left side outer surface is continuous with the radius roller circular curved portion.

The mounting portion left side has a ledge 352. The mounting portion left side ledge has an upper surface 354, a lower surface 356, and a terminal edge 358 protruding in an inward direction.

The mounting portion right side has a ledge 360. The mounting portion right side ledge has an upper surface 362 and a lower surface 364 and a terminal edge 366 protruding in an inward direction.

There is a gap 368 which is located between the mounting portion left side ledge terminal edge and the mounting portion right side ledge terminal edge.

There is a separation 370 located between the mounting portion left side ledge upper surface, the mounting portion right side ledge, the inner surface of the mounting portion top, the mounting portion right side inner surface, the mounting portion left side inner surface, the lower surface of the mounting portion left side ledge lower surface, and the mounting portion right side ledge lower surface, forming a bottom recess 372 in the bottom opening of the mounting portion.

The mounting portion bottom recess and the gap mate with and slidably receive the catch comb right component working end and the catch comb left component working end.

The current technique, to cut hair off the scalp in a controlled uniform method, is to use a regular comb, a user's hands, fingers & scissors. Using this technique, the user combs the hair to about a ninety degree orientation up and away from the scalp. The user grasps the hair and applies tension, on the hair, by squeezing the user's fingers together, and then making the cut.

To do an under/over hair radius cut line the user has to section off the hair, which is to be cut, into small sections. The user combs and grasps the hair while turning the user's hand and fingers to simulate a radius, around the user's fingers, and then the cut is made. This procedure is repeated numerous times, with the user having to approximate the location of the cut line.

Technically speaking the fingers grasping the hair section, to be cut, does not have an even balance of tension on the hair. Different, unbalanced, pressure points between the user's knuckles and bones in the user's fingers do not allow a precise copying of hair tension, and therefore, subsequent cuts will not be consistent.

The employment of the radius slider or the roller slider, allows the user to take whole sections of hair, grasp it in a controlled even balanced tension. The radius slider or roller slider all the user to pull, elevate and wrap the hair around a consistent radius or roller, providing a true circumference for a consistent hair cut.

Using this technique, the user may employ an electric razor, which has not been done in the past. This allows rapid, accurate cuts of the hair, producing a consistent hair cut.

Scissors may bunch and push a customer's hair away from its action with the closing the scissor blades. An electric razor will produce less push and bunching of the hair.

The catch comb using the radius slider or roller slider is unique and novel. It gives the user the ability to produce a prepped whole section of hair and cut it all at once with one pass of an electric razor, allowing a user to work efficiently while providing accurate cuts.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A catch comb comprising, in combination:

a pair of components being a right component and a left component, the right component having a handling end and a working end, the left component having a handling end and a working end, the left component and the right component being coupled thereby forming the catch comb working end and the catch comb handling end;

a grip trigger being coupled to the right component and the left component;

a fixed comb being coupled to the right component and the left component;

a movable gripper comb being slidably coupled to the right component and the left component, the movable gripper comb being operatively and movably coupled to the grip trigger;

the handling end of the right component and the handling end of the left component each having a generally rectilinear configuration with an inner surface and an outer surface with the outer surface comprising a top surface and a side surface and a bottom surface, the handling end of the right component and the handling end of the left component each having a proximal portion and a distal portion and the proximal portion and the distal portion of the handling end right component being continuous, and the proximal portion and the distal portion of the handling end left component being continuous;

the working end of the right component and the working end of the left component each having a generally rectilinear configuration, with the working end of the right component and the working end of the left component each having an inner surface and an outer surface, the outer surface of the working end right component and the outer surface of the working end left component comprising a top surface and a side surface and a bottom surface, the inner surface of the working end of the left component and the inner surface of the working end of the right component each having an inner surface recess therein;

the fixed comb having a generally rectilinear upper mounting portion and a multi toothed lower hair portion with the upper mounting portion having a distal end and a proximal end;

the movable gripper comb having a distal portion and a proximal portion, with the distal portion of the movable gripper comb and the proximal portion of the movable gripper comb being continuous;

the grip trigger having a upper end and a lower end, the grip trigger having a pair of generally parallel side surfaces and a front surface and a rear surface and an upper surface and a lower surface;

the handling end inner surface of the right component and the handling end inner surface of the left component each having a recess therein;

the working end right component and the working end left component each having a proximal portion and a distal portion;

the recess of the right component handling end and the recess of the left component handling end each having a plurality of spring nests therein, with each of the spring nests of the right component handling end and each of the spring nests of the left component handling end each having an associated spring;

the recess of the right component working end and the recess of the left component working end each having a plurality of spring nests therein with each of the spring nests of the working end of the right component and the spring nests of the working end of the left component each having an associated spring;

the distal portion of the movable gripper comb having an upper engaging portion and a lower portion having a plurality of comb teeth;

the teeth of the fixed comb each have a movable gripper comb groove there through, with each of the teeth of the movable gripper comb lower portion being configured to be slidably located within the movable gripper comb groove of the fixed comb multi toothed lower hair portion;

the inner surface of the left component handling end having plurality of joining apertures there in;

a grip, trigger lock being coupled to the right component and the left component with the grip trigger lock having a upper surface having a generally planar configuration;

the movable gripper comb multi toothed lower portion teeth each having a proximal surface and a distal surface and a pair of side surfaces;

the movable gripper comb teeth having an engaged location and the movable gripper comb teeth having a stored location, with the stored location having the teeth contained with the movable gripper comb groove of the fixed comb multi toothed lower hair portion;

the proximal portion of the movable gripper comb having an upper surface and a lower surface and a pair of generally parallel side surfaces;

the lower end of the grip trigger having a finger aperture there through;

the proximal portion of the working end right component being continuous with the distal portion of the handling end right component, the proximal portion of the working end left component being continuous with the distal portion of the handling end left component;

the recess of the handling end right component and the recess of the handling end left component each having a plurality of handling end comb travel stops;

the inner surface of the handling end right component having a plurality of joining protuberances which are configured to accept and mate with the joining apertures of the left component handling end inner surface;

the upper end of the grip trigger having a trigger pin boss aperture there through;

the recess of the working end right component and the recess of the left component each having a plurality of comb travel stops;

the grip trigger lock having a lower surface, the lower surface of the grip trigger lock having a stepped configuration and a pair parallel, planar side surfaces;

the upper surface of the proximal portion of the movable gripper comb having grip trigger upward extension and a plurality of spring recesses therein;

the bottom surface of the left component handling end and the bottom surface of the right component handling end each having an stepped grip trigger recess therein;

the working end right component and the working end left component each having a plurality of fastener holes therein;

the lower surface of the proximal portion of the movable gripper comb having a grip trigger cam lobe cutout and a plurality of spring recesses therein;

the trigger pin boss aperture sized to rotatably mount the grip trigger on a trigger pin boss;

the proximal portion of the right component handling end and the proximal portion of the left component handling end each having a terminus with the terminus comprising at least one fixed hair pick protruding proximally from the terminus of the left component handling end proximal portion and the right component handling end proximal portion;

the handling end right component and the handling end left component each having a plurality of fastener holes there through with each of the fastener holes of the working end of the right component and the working end of the left component having an associated fastener;

the side surfaces of the handling end right component and the handling end left component each having a grip trigger lock retaining pin hole there through;

the upper mounting portion of the fixed comb distal end and the upper mounting portion of the fixed comb proximal end each having a mounting pin hole there through; and the upper engaging portion of the distal portion of the movable gripper comb having a generally T-shaped configuration with an upper surface and a pair of parallel side surfaces and a lower surface.

2. The catch comb as described in claim 1 with the catch comb further comprising:

each of the fastener holes of the right component handling end and of the left component handling end having an associated fastener;

the inner surface of the left component handling end and inner surface of the right component handling end each having a trigger pin boss;

the bottom surface of the working end right component and the bottom surface of the working end left component being coupled to form a stepped slot on the bottom surface of the coupled right component working end and left component working end;

the fixed comb upper mounting portion distal end and the fixed comb upper mounting portion proximal end each having mounting pin holes, with each mounting pin hole having an associated mounting pin;

the lower surface of the upper engaging portion of the distal portion of the movable gripper comb being continuous with the multi toothed lower portion of the distal portion of the movable gripper comb; and the upper mounting portion of the fixed comb being sized to be fixedly held within the first step of the stepped slot of the bottom surface of the working end right component and the stepped slot of the bottom surface of the working end left component.

3. The catch comb as described in claim 2 with the catch comb further comprising:

the left component handling end proximal portion and the right component handling end proximal portion each having a plurality of removable hair pick recesses therein, with the hair pick recesses having associated removable hair picks;

the right component handling end outer side surface and the left component handling end outer side surface each having a rotatable angle indicator recess therein;

the trigger pin boss having a trigger pin aperture there through;

the working end bottom surface stepped slot first step and the working end bottom surface stepped slot second step each having a side to side distance, with the side to side distance of the second step being greater than the side to side distance of the first step;

the movable gripper comb multi toothed lower portion teeth having a terminus;

the upper engaging portion of the distal portion of the movable gripper comb having a plurality of upwardly disposed spring contacting extensions; and a rotatable angle indicator.

4. The catch comb as described in claim 3 with the catch comb further comprising:

the removable hair picks being inserted into the hair pick recesses with the hair picks protruding proximally from the terminus of the left component handling end proximal portion and the right component handling end proximal portion;

each rotatable angle indicator recess having an associated rotatable angle indicator and a rotatable angle indicator pin; and the trigger pin aperture having an associated trigger pin.

5. The catch comb as described in claim 4 with the catch comb further comprising:

the top surface of the left component handling end and the top surface of the right component handling end each having a grip trigger lock recess therein; and each of the upwardly disposed spring contacting extensions having a generally rectilinear configuration.

6. The catch comb as described in claim 5 with the catch comb further comprising:

each grip trigger lock recess having a grip trigger lock retaining pin hole there through;

the left component handling end trigger lock retaining pin hole and right component handling end grip trigger lock retaining pin hole each having an associated grip trigger lock retaining pin; and the catch comb right component and catch comb left component and fixed comb and movable gripper comb each being fabricated of a rigid material.

7. A catch comb comprising, in combination:

a pair of components being a right component and a left component with the right component and the left component each having a handling end, with the handling end of the right component and the left component each having a proximal portion;

a grip trigger being rotatably coupled to the right component and the left component;

a fixed comb being coupled to the right component and the left component;

a movable gripper comb being slidably coupled to the right component and the left component, the movable gripper comb being operatively and movably coupled to the grip trigger;

a grip trigger lock being coupled to the right component and the left component;

a rotatable angle indicator;

the rotatable indicator being rotatably coupled to the proximal handling end portion of the right component and the proximal handling end portion of the left component; and a radius slider having a mounting portion and a semicircular curved portion and a connecting extension, the radius slider connecting extension being continuous with the radius slider mounting portion, the radius slider semicircular portion having an outer surface and an inner surface and a proximal end and a distal end, with the distal end of the semicircular portion of the radius slider having an terminal edge, the radius slider semicircular portion having a first end and a second end, the proximal end of the semicircular portion of the radius slider being continuous with the connecting extension.

8. The catch comb as described in claim 7 with the catch comb further comprising the mounting portion having a generally C-shaped configuration having a top and a bottom with an opening therein and a pair of generally parallel sides being a mounting portion right side and a mounting portion left side, the mounting portion top having an outer surface and an inner surface with a thickness there between, and the mounting portion left side having an outer surface and an inner surface with a thickness there between, and the mounting portion right side having an outer surface and an inner surface with a thickness there between, the mounting portion right side outer surface being continuous with the connecting extension.

9. The catch comb as described in claim 8 with the catch comb further comprising the mounting portion left side having a ledge having an upper surface and a lower surface and a terminal edge protruding in an inward direction.

10. The catch comb as described in claim 9 with the catch comb further comprising the mounting portion right side having a ledge having an upper surface and a lower surface and a terminal edge protruding in an inward direction.

11. The catch comb as described in claim 10 with the catch comb further comprising a gap, the gap being located between the mounting portion left side ledge terminal edge and the mounting portion right side ledge terminal edge.

12. The catch comb as described in claim 11 with the catch comb further comprising a separation, the separation being located between the mounting portion left side ledge upper surface and the mounting portion right side ledge and the inner surface of the mounting portion top, the mounting portion right side inner surface and the mounting portion left side inner surface and the lower surface of the mounting portion left side ledge lower surface and the mounting portion right side ledge lower surface forming a bottom recess in the bottom opening of the mounting portion.

13. The catch comb as described in claim 12 with the catch comb further comprising the mounting portion bottom recess and the gap mating with and slidably receiving the catch comb right component working end and the catch comb left component working end.

* * * * *